US010823433B2

(12) United States Patent
Cho et al.

(10) Patent No.: US 10,823,433 B2
(45) Date of Patent: Nov. 3, 2020

(54) AIR CONDITIONER

(71) Applicant: SAMSUNG ELECTRONICS CO., LTD., Suwon-si, Gyeonggi-do (KR)

(72) Inventors: Sung-June Cho, Suwon-si (KR); Kwon Jin Kim, Suwon-si (KR); Sung Jae Kim, Seongnam-si (KR); Seon Uk Na, Yongin-si (KR); Yeon-Seob Yun, Hwaseong-si (KR); Young Uk Yun, Suwon-si (KR); Kyeong Ae Lee, Suwon-si (KR); Byung Han Lim, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 243 days.

(21) Appl. No.: 15/983,531

(22) Filed: May 18, 2018

(65) Prior Publication Data

US 2018/0335221 A1 Nov. 22, 2018

(30) Foreign Application Priority Data

May 18, 2017 (KR) ..... 10-2017-0061375
May 16, 2018 (KR) ..... 10-2018-0056127

(51) Int. Cl.
*F24F 1/0014* (2019.01)
*F24F 1/005* (2019.01)
(Continued)

(52) U.S. Cl.
CPC ..... *F24F 1/0014* (2013.01); *F24F 1/005* (2019.02); *F24F 1/0022* (2013.01);
(Continued)

(58) Field of Classification Search
CPC ..... F24F 1/0014; F24F 1/005; F24F 1/0033; F24F 6/00; F24F 13/28; F24F 1/0029;
(Continued)

(56) References Cited

U.S. PATENT DOCUMENTS

2006/0086138 A1* 4/2006 Park ..... F24F 1/0007 62/428
2014/0000852 A1* 1/2014 Kim ..... F24F 7/007 165/121
(Continued)

FOREIGN PATENT DOCUMENTS

CN 106403033 2/2017
JP 63-271072 11/1988
(Continued)

OTHER PUBLICATIONS

PCT International Search Report issued in PCT International Application No. PCT/KR2018/005671 dated Sep. 18, 2018 (3 pages total).
(Continued)

*Primary Examiner* — Minh Chau T Pham
(74) *Attorney, Agent, or Firm* — Staas & Halsey LLP

(57) ABSTRACT

An air conditioner includes a housing having a first inlet port and a second inlet port, a first discharge port, a second discharge port, the air discharged through the second discharge port is mixed with the air discharged through the first discharge port, and having a plurality of discharge holes to cause the air discharged from the first discharge port to be discharged more slowly than air discharged from the second discharge port, a heat exchanger configured to heat-exchange the air entered through the first inlet port, a first fan arranged to draw the air into the housing through the first inlet port, and to discharge the air from the housing through the first discharge port, and a second fan arranged to draw the air into the housing through the second inlet port, and to
(Continued)

discharge the air from the housing through the second discharge port.

19 Claims, 26 Drawing Sheets

(51) Int. Cl.

| | |
|---|---|
| ***F24F 1/0033*** | (2019.01) |
| ***F24F 1/0022*** | (2019.01) |
| ***F24F 1/0029*** | (2019.01) |
| ***F24F 6/00*** | (2006.01) |
| ***F24F 13/28*** | (2006.01) |

(52) U.S. Cl.
CPC ..... *F24F 1/0029* (2013.01); *F24F 1/0033* (2013.01); *F24F 6/00* (2013.01); *F24F 13/28* (2013.01); *F24F 2006/008* (2013.01)

(58) Field of Classification Search
CPC .. F24F 1/0022; F24F 2006/008; F24F 13/085; F24F 13/081
USPC ..... 55/472, 473; 62/426, 427, 263; 165/99, 165/122, 126, DIG. 312, DIG. 313, 165/DIG. 314; 415/176, 178, 186, 191, 415/207, 208.2, 211.1, 211.2, 218.2, 223
See application file for complete search history.

(56) References Cited

U.S. PATENT DOCUMENTS

| | | | | |
|---|---|---|---|---|
| 2017/0067698 | A1* | 3/2017 | O'Brien | B60H 1/00464 |
| 2017/0248153 | A1* | 8/2017 | Park | F24F 1/0071 |
| 2017/0248339 | A1* | 8/2017 | Mun | B01D 46/0047 |

FOREIGN PATENT DOCUMENTS

| | | |
|---|---|---|
| JP | 6-337133 | 12/1994 |
| JP | 9-210390 | 8/1997 |
| JP | 2012-97911 | 5/2012 |
| JP | 2015-45500 | 3/2015 |
| KR | 2000-0056578 | 9/2000 |
| KR | 10-2006-0073247 | 6/2006 |
| KR | 10-2008-0055454 | 6/2008 |
| KR | 10-2011-0018740 | 2/2011 |
| KR | 10-2016-0051095 | 5/2016 |
| KR | 10-2017-0009701 | 1/2017 |
| KR | 10-2017-0010293 | 1/2017 |

OTHER PUBLICATIONS

Extended European Search Report dated Mar. 6, 2020 in European Patent Application No. 18801445.0.

* cited by examiner

AIR CONDITIONER

CROSS-REFERENCE TO RELATED APPLICATION

This application is based on and claims priority under 35 U.S.C. § 119 to Korean Patent Application Nos. 10-2017-0061375 filed on May 18, 2017, and 10-2018-0056127, filed on May 16, 2018, in the Korean Intellectual Property Office, the disclosure of which is incorporated by reference herein in its entirety.

BACKGROUND

1. Field

The present disclosure relates to an air conditioner, and more particularly, to an air conditioner capable of performing various air discharge methods.

2. Description of the Related Art

In general, an air conditioner is an apparatus for adjusting temperature, humidity, air current, and distribution to optimal conditions for human activities using a cooling cycle, while removing dust, etc. from the air. Main components constituting the cooling cycle include a compressor, a condenser, an evaporator, an expansion valve, and a fan.

The air conditioner can be classified into a split type air conditioner in which an indoor unit is separated from an outdoor unit, and a window type air conditioner in which an indoor unit and an outdoor unit are installed together in a single cabinet. The indoor unit of the split type air conditioner includes a heat exchanger for heat-exchanging air drew to the inside of the panel, and a fan for drawing indoor air to the inside of the panel and again discharging the drew air to indoor space.

In the case of an indoor unit of a typical air conditioner, when a user directly contacts discharged air, he/she may feed cold and displeasure, and when he/she does not contact discharged air, he/she may feel hot and displeasure.

SUMMARY

Therefore, it is an aspect of the present disclosure to provide an air conditioner capable of performing various air discharge methods.

It is another aspect of the present disclosure to provide an air conditioner capable of cooling or heating indoor space at a minimum wind speed at which a user feels pleasant.

It is another aspect of the present disclosure to provide an air conditioner capable of providing natural wind not heat-exchanged.

It is another aspect of the present disclosure to provide an air conditioner capable of providing heat-exchanged air and air mixed with indoor air.

Additional aspects of the disclosure will be set forth in part in the description which follows and, in part, will be apparent from the description, or may be learned by practice of the disclosure.

In accordance with an aspect of the present disclosure, an air conditioner includes a housing having a first inlet port and a second inlet port, a first discharge port formed in the housing, and configured to discharge air entered through the first inlet port, a second discharge port formed in the housing, and configured to discharge air entered through the second inlet port, wherein air to be discharged through the second discharge port is mixed with air to be discharged through the first discharge port, a discharge panel disposed in a portion of the housing in which the first discharge port is formed, and having a plurality of discharge holes to cause the air discharged from the first discharge port to be discharged more slowly than the air discharged from the second discharge port, a heat exchanger configured to heat-exchange the air entered through the first inlet port, a first fan arranged to draw the air into the housing through the first inlet port, and to discharge the air from the housing through the first discharge port, and a second fan arranged to draw the air into the housing through the second inlet port, and to discharge the air from the housing through the second discharge port.

The housing may include a guide curved portion formed on the second discharge port, and configured to guide the air to be discharged through the second discharge port so that the air discharged through the second discharge port is mixed the air discharged through the first discharge port.

The air conditioner may further include a first flow path to connect the first inlet port to the first discharge port so that the air entered through the first inlet port flows through the first flow path and discharges through the first discharge port, and a second flow path to connect the second inlet port to the second discharge port so that the air entered through the first inlet port flows through the first flow path and discharges through the first discharge port, and partitioned from the first flow path so that the first flow path and the second flow path are independent of each other.

The first discharge port may be formed in a front surface of the housing, the second discharge port may be formed in at least one side of the housing, and the guide curved portion may guide the air to be discharged through the second discharge port, toward a front direction.

The first inlet port and the second inlet port may be formed in a rear surface of the housing.

The second discharge port may include a blade configured to change a direction of the air to be discharged through the second discharge port.

The air conditioner may further include an air cleaning unit disposed on the second flow path to filter the air flows through the second flow path.

The air conditioner may further include a humidification unit disposed on the second flow path to provide moisture to the air flows through the second flow path.

The housing may include a case in which the humidification unit is installed, and a front panel is attachable to or the detachable from the case.

The first fan may include an axial-flow fan, and the second fan may include a centrifugal fan.

The second fan may be driven independently from the first fan.

The first fan may be configured to adjust air volume and a wind speed of the air to be discharged through the first discharge port, and the second fan may be configured to adjust air volume and a wind speed of the air to be discharged through the second discharge port.

The second discharge port may be disposed above or below the first discharge port.

The heat exchanger may be disposed between the first discharge port and the first fan on the first flow path.

The first discharge port may discharge the air entered through the first inlet port and heat-exchanged by the heat exchanger, and the second discharge port may discharge the air entered through the second inlet port and not heat-exchanged.

In accordance with an aspect of an example embodiment, an air conditioner includes a housing having a first inlet port and a second inlet port, a first discharge port formed in the housing, and configured to discharge air entered through the first inlet port, a second discharge port formed in the housing, and configured to discharge air entered through the second inlet port, a first flow path to connect the first inlet port to the first discharge port so that the air entered through the first inlet port flows through the first flow path and discharges through the first discharge port, a second flow path to connect the second inlet port to the second discharge port so that the air entered through the first inlet port flows through the first flow path and discharges through the first discharge port, and partitioned from the first flow path so that the first flow path and the second flow path are independent of each other, a heat exchanger disposed on the first flow path, and a discharge panel disposed in a portion of the housing in which the first discharge port is formed, and having a plurality of discharge holes through which the air flows through the first flow path is to be discharged, wherein the housing comprises a guide curved portion formed on the second discharge port, and configured to guide the air to be discharged through the second discharge port so that the air discharged through the second discharge port is mixed the air discharged through the first discharge port.

The second discharge port may include a blade rotatably coupled with the housing, and configured to change a direction of the air to be discharged through the second discharge port.

The plurality of discharge holes of the discharge panel may cause the air discharged from the first discharge port to be discharged more slowly than the air discharged from the second discharge port.

The second fan may include a centrifugal fan.

In accordance with an aspect of an example embodiment, an air conditioner includes a housing having a first inlet port and a second inlet port, a first discharge port formed in a front surface of the housing, and configured to discharge air entered through the first inlet port, a second discharge port formed in both sides of the housing, and configured to discharge air entered through the second inlet port, a first flow path to connect the first inlet port to the first discharge port so that the air entered through the first inlet port flows through the first flow path and discharges through the first discharge port, a second flow path to connect the second inlet port to the second discharge port so that the air entered through the first inlet port flows through the first flow path and discharges through the first discharge port, and partitioned from the first flow path, and a heat exchanger disposed on the first flow path so that the first flow path and the second flow path are independent of each other, wherein the second discharge port is disposed adjacent to the first discharge port such that the air discharged through the second discharge port is mixed with the air discharged through the first discharge port, and wherein a wind speed of air discharged through the second discharge port is higher than a wind speed of air discharged through the first discharge port.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
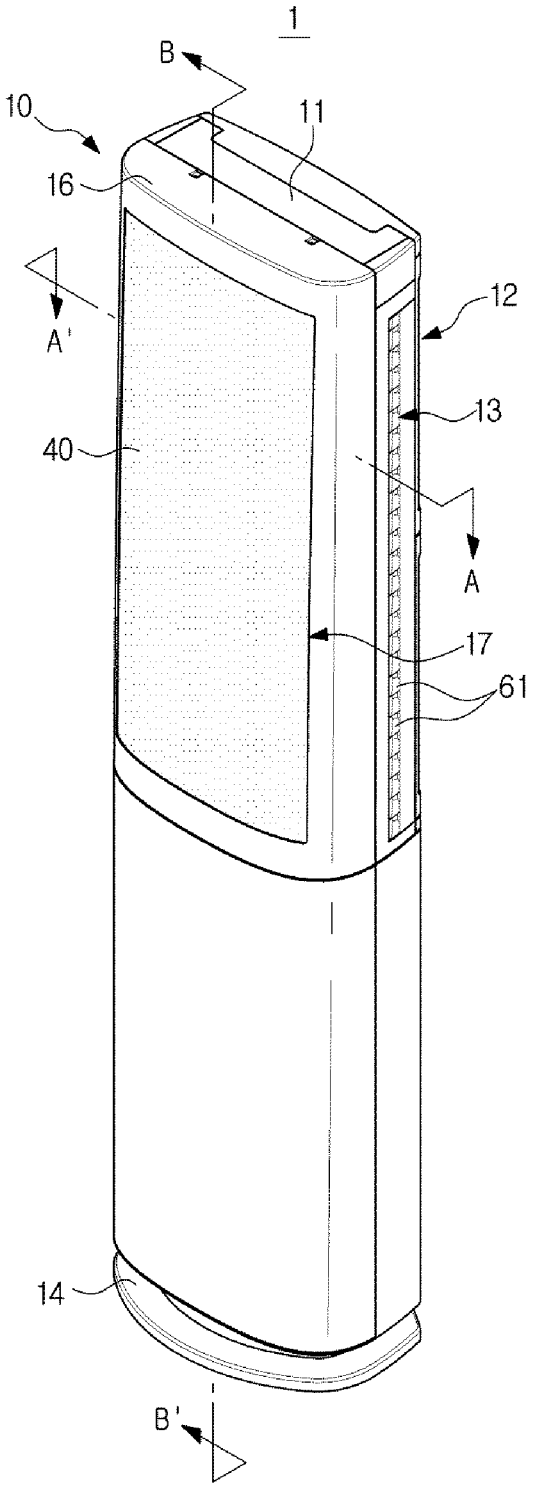
FIG. 1 is a perspective view of an air conditioner according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

Also, it will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "upper", "lower", "left", and "right" are defined based on the drawings, and the shapes and positions of the components are not limited by the terms.

A cooling cycle constituting an air conditioner may be configured with a compressor, a condenser, an expansion valve, and an evaporator. The cooling cycle may perform a series of processes of compression-condensation-expansion-evaporation so as to heat-exchange air with refrigerants and then supply air-conditioned air.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process.

The expansion valve may expand the liquid-state refrigerants in the high-temperature, high-pressure state condensed by the condenser to liquid-state refrigerants in a low-pressure state. The evaporator may evaporate the refrigerants expanded by the expansion valve, and return the refrigerant gas in the low-temperature, low-pressure state to the compressor. The evaporator may achieve a cooling effect through heat-exchange with an object to be cooled using evaporative latent heat of refrigerants. Through the cycle, the air conditioner can adjust the temperature of indoor space.

An outdoor unit of the air conditioner may be a part of the cooling cycle, configured with the compressor and an outdoor heat exchanger. An indoor unit of the air conditioner may include an indoor heat exchanger, and the expansion valve may be installed in any one of the indoor unit and the outdoor unit. The indoor heat exchanger and the outdoor heat exchanger may function as a condenser or an evaporator. When the indoor heat exchanger is used as a condenser, the air conditioner may function as a heater, and when the indoor heat exchanger is used as an evaporator, the air conditioner may function as a cooler.

Hereinafter, the embodiments of the present disclosure will be described in detail with reference to the accompanying drawings.

Figure 2:
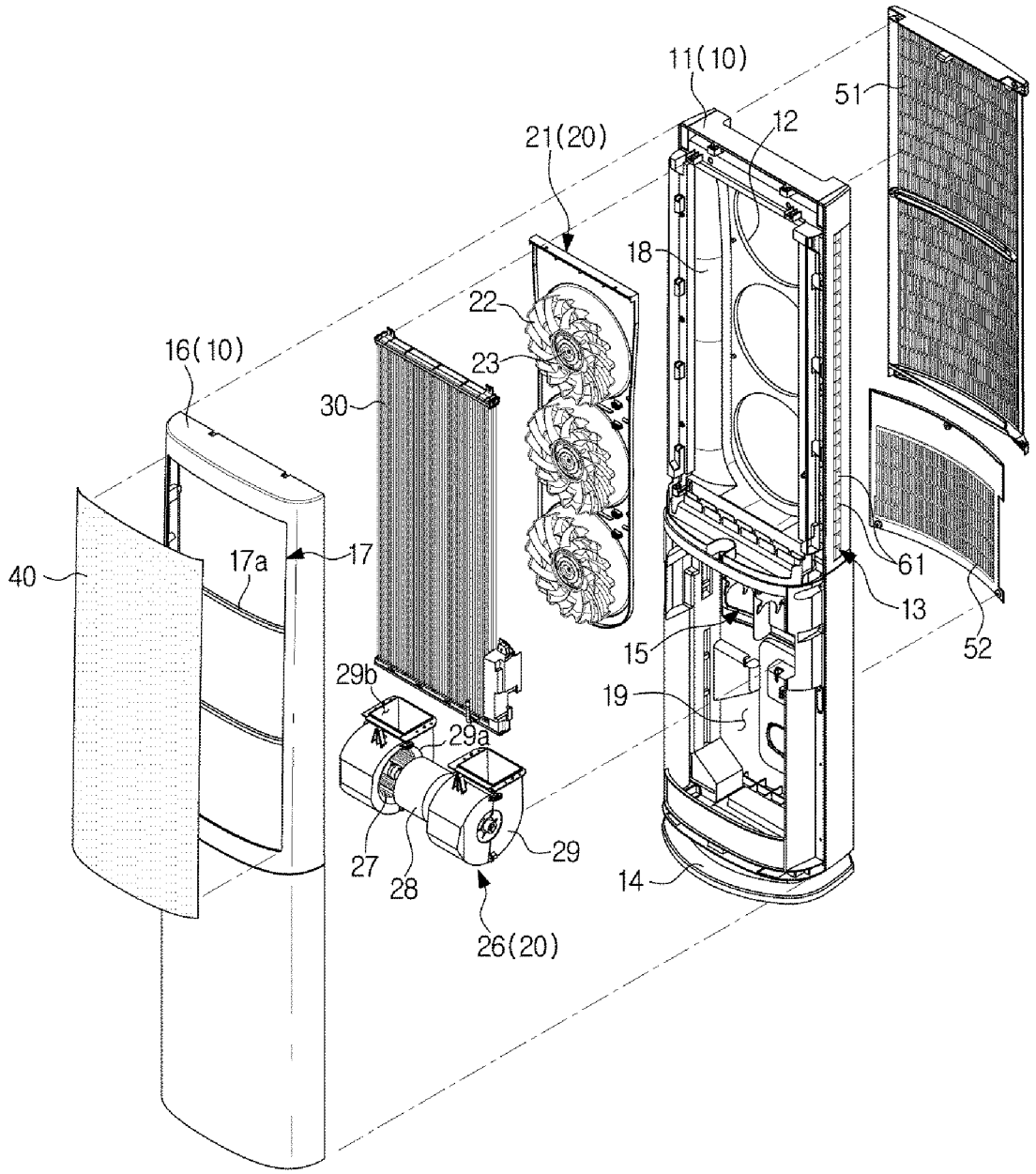
FIG. 2 is an exploded perspective view of the air conditioner shown in FIG. 1.

FIG. 1 is a perspective view of an air conditioner according to an embodiment of the present disclosure. FIG. 2 is an exploded perspective view of the air conditioner shown in FIG. 1.

Referring to FIGS. 1 and 2, an air conditioner 1 may include a housing 10 forming an outer appearance of the air conditioner 1, a blow unit 20 for circulating air to the inside or outside of the housing 10, and a heat exchanger 30 for heat-exchanging air entered the inside of the housing 10.

The housing 10 may include a case 11 in which the blow unit 20 and the heat exchanger 30 are installed, and a front panel 16 for covering a front surface of the case 11. The housing 10 may include a first inlet port 12, a second inlet port 15, a first discharge port 17, and a second discharge port 13.

The case 11 may form a rear surface of the air conditioner 1, a part of both sides of the air conditioner 1, a part of an upper surface of the air conditioner 1, and a bottom of the air conditioner 1. A front portion of the case 11 may be open, and the open front portion of the case 11 may be covered by the front panel 16. In FIG. 2, the front panel 16 is shown to be separable from the case 11, however, the front panel 16 may be integrated into the case 11.

In the front panel 16, the first discharge port 17 may be formed. The first discharge port 17 may be formed in the front surface of the housing 10. The first discharge port 17 may penetrate the front panel 16. The first discharge port 17 may be formed in an upper portion of the front panel 16. The first discharge port 17 may face the first inlet port 12. Air heat-exchanged in the inside of the housing 10 may be discharged to the outside of the housing 10 through the first discharge port 17. The first discharge port 17 may discharge air entered through the first inlet port 12.

In the portion of the front panel 16 in which the first discharge port 17 is formed, a panel support portion 17*a* for supporting a discharge panel 40 may be formed. The panel support portion 17*a* may cross the first discharge port 17 to support a rear surface of the discharge panel 40.

In the case 11, the first inlet port 12 may be formed. The first inlet port 12 may penetrate a rear portion of the case 11. The first inlet port 12 may be formed in a rear upper portion of the case 11. Outside air may enter the inside of the housing 10 through the first inlet port 12.

In the embodiment of FIG. 2, three first inlet ports 12 are formed. However, the number of the first inlet ports 12 is not limited to three. That is, an arbitrary number of the first inlet ports 12 may be provided as necessary. In FIG. 2, the first inlet port 12 is in the shape of a circle. However, the shape of the first inlet port 12 is also not limited to a circle, and may have various shapes as necessary.

In the case 11, the second inlet port 15 may be formed. The second inlet port 15 may penetrate the rear portion of the case 11. The second inlet port 15 may be formed in a rear lower portion of the case 11. The second inlet port 15 may be formed below the first inlet port 12. Outside air may enter the inside of the housing 10 through the second inlet port 15.

Like the first inlet port 12, the second inlet port 15 may be formed in various numbers and/or shapes as necessary.

In the case 11, the second discharge port 13 may be formed. The second discharge port 13 may be disposed adjacent to the first discharge port 17. The second discharge port 13 may be disposed in at least one side of the case 11. The second discharge port 13 may penetrate the side of the case 11. The second discharge port 13 may be formed in an upper portion of the side of the case 11. The second discharge port 13 may be formed in both sides of the housing 10 to correspond to the portion of the housing 10 in which the first discharge port 17 is formed.

The second discharge port 13 may extend in up and down directions of the case 11. Air not heat-exchanged in the inside of the housing 11 may be discharged to the outside of the housing 10 through the second discharge port 13. The second discharge port 13 may discharge air entered through the second inlet port 15.

The second discharge port 13 may mix air to be discharged therethrough with air to be discharged through the first discharge port 17. More specifically, in the portion of the case 11 in which the second discharge port 13 is formed, a guide curved portion 13*a* for guiding air to be discharged through the second discharge port 13 may be formed to mix the air with air to be discharged through the first discharge port 17.

The guide curved portion 13*a* may guide air to be discharged through the second discharge port 13 by the Coanda effect. That is, air to be discharged through the second discharge port 13 may flow along the guide curved portion 13*a* to be mixed with air to be discharged through the first discharge port 17. When the second discharge port 13 is disposed in the side of the housing 10 and the first discharge port 17 is disposed in the front portion of the housing 10, the guide curved portion 13*a* may guide air to be discharged through the second discharge port 13, toward a front direction.

On the second discharge port 13, a plurality of blades 61 may be provided to guide air to be discharged through the second discharge port 13. The plurality of blades 61 may be arranged successively along a longitudinal direction of the second discharge port 13.

A path of air connecting the first inlet port 12 to the first discharge port 17 is referred to as a first flow path S1, and a path of air connecting the second inlet port 15 to the second discharge port 13 is referred to as a second flow path S2. Herein, the first flow path S1 may be partitioned from the second flow path S2. Accordingly, air flowing along the first flow path S1 may be not mixed with air flowing along the second flow path S2.

More specifically, the first flow path S1 may be partitioned from the second flow path S2 by a partition plate 18. The partition plate 18 may extend in the up and down directions in the inside of the housing 10 where a first blow unit 21 is installed. The partition plate 18 may extend in a direction in which the second discharge port 13 is formed. The partition plate 18 may protrude convexly from an inner side surface of the housing 10.

The air conditioner 1 may discharge air heat-exchanged with the heat exchanger 30 through the first discharge port 17, and discharge air not passed the heat exchanger 30 through the second discharge port 13. That is, the second discharge port 13 may discharge air not heat-exchanged. Since the heat exchanger 30 is disposed on the first flow path S1, air discharged through the first discharge port 17 may be heat-exchanged air. Since no heat exchanger is disposed on the second flow path S2, air discharged through the second discharge port 13 may be air not heat-exchanged.

However, heat-exchanged air may be discharged through the second discharge port 13. That is, a heat exchanger may be disposed on the second flow path S2. More specifically, a heat exchanger for heat-exchanging air to be discharged through the second discharge port 13 may be disposed in accommodating space 19 of the case 11. According to the configuration, the air conditioner 1 may provide heat-exchanged air through both the first discharge port 17 and the second discharge port 13.

In the case 11, a support stand 14 may be provided. The support stand 14 may be disposed at the bottom of the case 11. The support stand 14 may support the housing 10 stably on the floor.

In the inside of the case 11, the accommodating space 19 may be formed to accommodate electronic components (not shown). In the accommodating space 19, electronic components required for driving the air conditioner 1 may be disposed. A second blow unit 26 may be disposed in the accommodating space 19.

The blow unit 20 may include the first blow unit 21 and the second blow unit 26. The second blow unit 26 may be driven independently from the first blow unit 21. The second blow unit 26 may rotate at revolutions per minute (RPM) that is different from that of the first blow unit 21.

The first blow unit 21 may be disposed on the first flow path S1 formed between the first inlet port 12 and the first discharge port 17. Air entered through the first inlet port 12 may move to the inside of the housing 10 by the first blow unit 21. The air entered through the first inlet port 12 may move along the first flow path S1 to be discharged to the outside of the housing 10 through the first discharge port 17. The first blow unit 21 may include a first fan 22 and a first fan driver 23.

The first fan 22 may be an axial-flow fan or a diagonal fan although not limited thereto. However, the first fan 22 may be any other fan as long as it can make air entered from the outside of the housing 10 flow to discharge the air to the outside of the housing 10. For example, the first fan 22 may be a cross fan, a turbo fan, or a sirocco fan.

In the embodiment of FIG. 2, three first fans 22 are provided. However, the number of the first fans 22 is not limited to three. That is, an arbitrary number of the first fans 22 may be provided as necessary.

The first fan driver 23 may drive the first fan 22. The first fan driver 23 may be disposed at the center of the first fan 22. The first fan driver 23 may include a motor.

The second blow unit 26 may be disposed on the second flow path S2 formed between the second inlet port 15 and the second discharge port 13. Air entered through the second inlet port 15 may move to the inside of the housing 10 by the second blow unit 26. The air entered through the second inlet port 15 may move along the second flow path S2 to be discharged to the outside of the housing 10 through the second discharge port 13.

The second blow unit 26 may include a second fan 27, a second fan driver 28, and a fan case 29.

The second fan 27 may be a centrifugal fan although not limited thereto. However, the second fan 27 may be any other fan as long as it can make air entered from the outside of the housing 10 flow to discharge the air to the outside of the housing 10. For example, the second fan 27 may be a cross fan, a turbo fan, or a sirocco fan.

In the embodiment of FIG. 2, two second fans 27 are provided. However, the number of the second fans 27 is not limited to two. That is, an arbitrary number of the second fans 27 may be provided as necessary.

The second fan driver 28 may drive the second fan 27. The second fan driver 28 may be disposed at the center of the second fan 27. The second fan driver 28 may include a motor.

The fan case 29 may cover the second fan 27. The fan case 29 may include a fan inlet 29*a* through which air enters, and a fan outlet 29*b* through which air is discharged. The fan inlet 29*a* and the fan outlet 29*b* may be disposed at predetermined locations according to the kind of the second fan 27.

In the second blow unit 26 shown in FIG. 2, the second fans 27 are respectively disposed at both ends of the second fan driver 28. However, the configuration of the second blow unit 26 is not limited to this. For example, two second fan drivers 28 may be provided to drive the second fans 27 respectively.

The heat exchanger 30 may be disposed between the first blow unit 21 and the first discharge port 17. The heat exchanger 30 may be disposed on the first flow path S1. The heat exchanger 30 may absorb heat from air entered through the first inlet port 12, or transfer heat to air entered through the first inlet port 12. The heat exchanger 30 may include a tube, and a header coupled with the tube. However, the kind of the heat exchanger 30 is not limited to this.

The air conditioner 1 may include the discharge panel 40 disposed in the portion of the front panel 16 in which the first discharge port 17 is formed. The discharge panel 40 may have a plurality of discharge holes to cause air discharged from the first discharge port 17 to be discharged more slowly than air discharged from the second discharge port 13. The plurality of discharge holes may penetrate the discharge panel 40. The plurality of discharge holes may be formed with a fine size. Also, the plurality of discharge holes may be distributed uniformly throughout the entire area of the discharge panel 40. Heat-exchanged air discharged through the first discharge port 17 may be discharged at low speed by the plurality of discharge holes.

The air conditioner 1 may include a first inlet grill 51 coupled with the portion of the case 11 in which the first inlet port 12 is formed. The first inlet grill 51 may prevent foreign materials from entering through the first inlet port 12. In order to prevent foreign materials from entering through the first inlet port 12, the first inlet grill 51 may include a plurality of slits or holes. The first inlet grill 51 may cover the first inlet port 12.

The air conditioner 1 may include a second inlet grill 52 coupled with the portion of the case 11 in which the second inlet port 15 is formed. The second inlet grill 52 may prevent foreign materials from entering through the second inlet port 15. In order to prevent foreign materials from entering through the second inlet port 15, the second inlet grill 52 may include a plurality of slits or holes. The second inlet grill 52 may cover the second inlet port 15.

Figure 3:
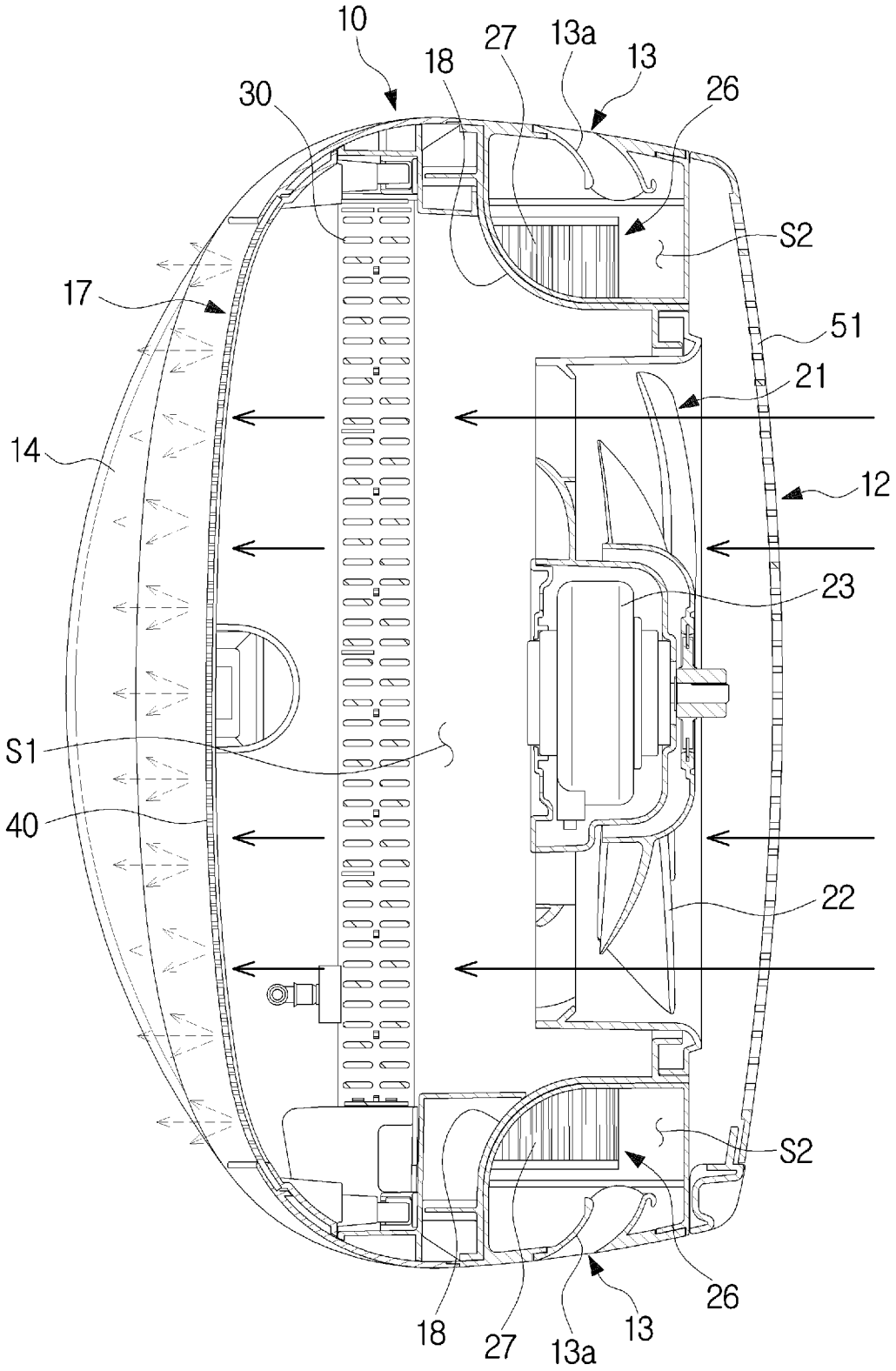
FIG. 3 is a cross-sectional view of the air conditioner shown in FIG. 1, taken along line A-A' of FIG. 1, when the air conditioner operates in a first mode.
Figure 4:
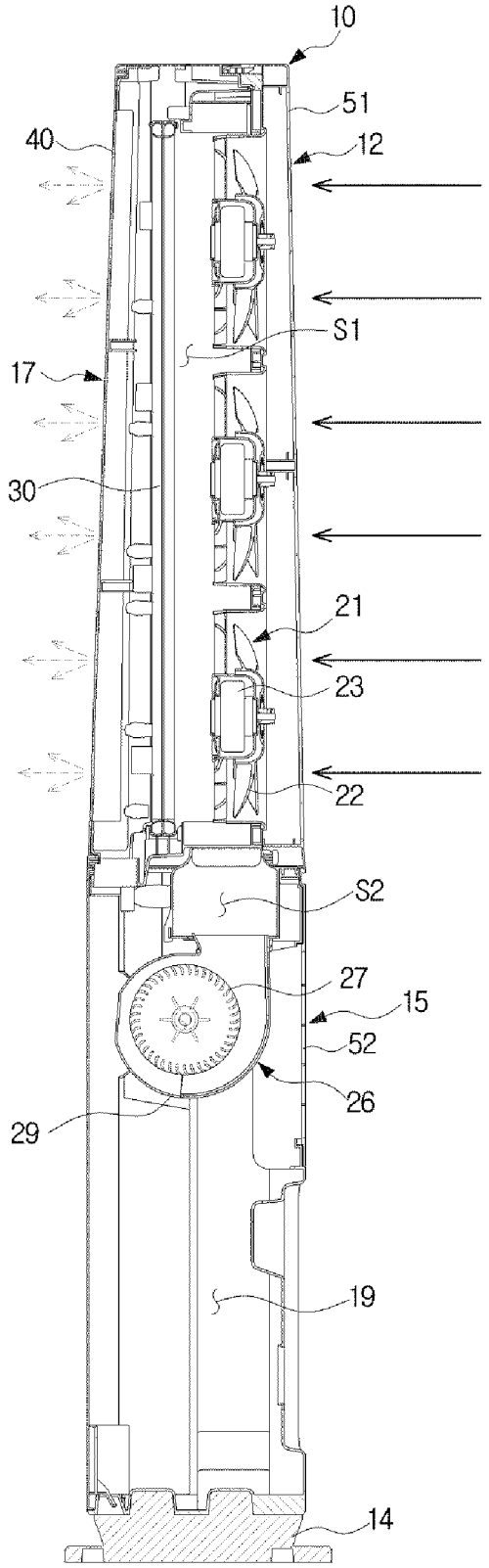
FIG. 4 is a cross-sectional view of the air conditioner shown in FIG. 1, taken along line B-B' of FIG. 1, when the air conditioner operates in the first mode.
Figure 5:
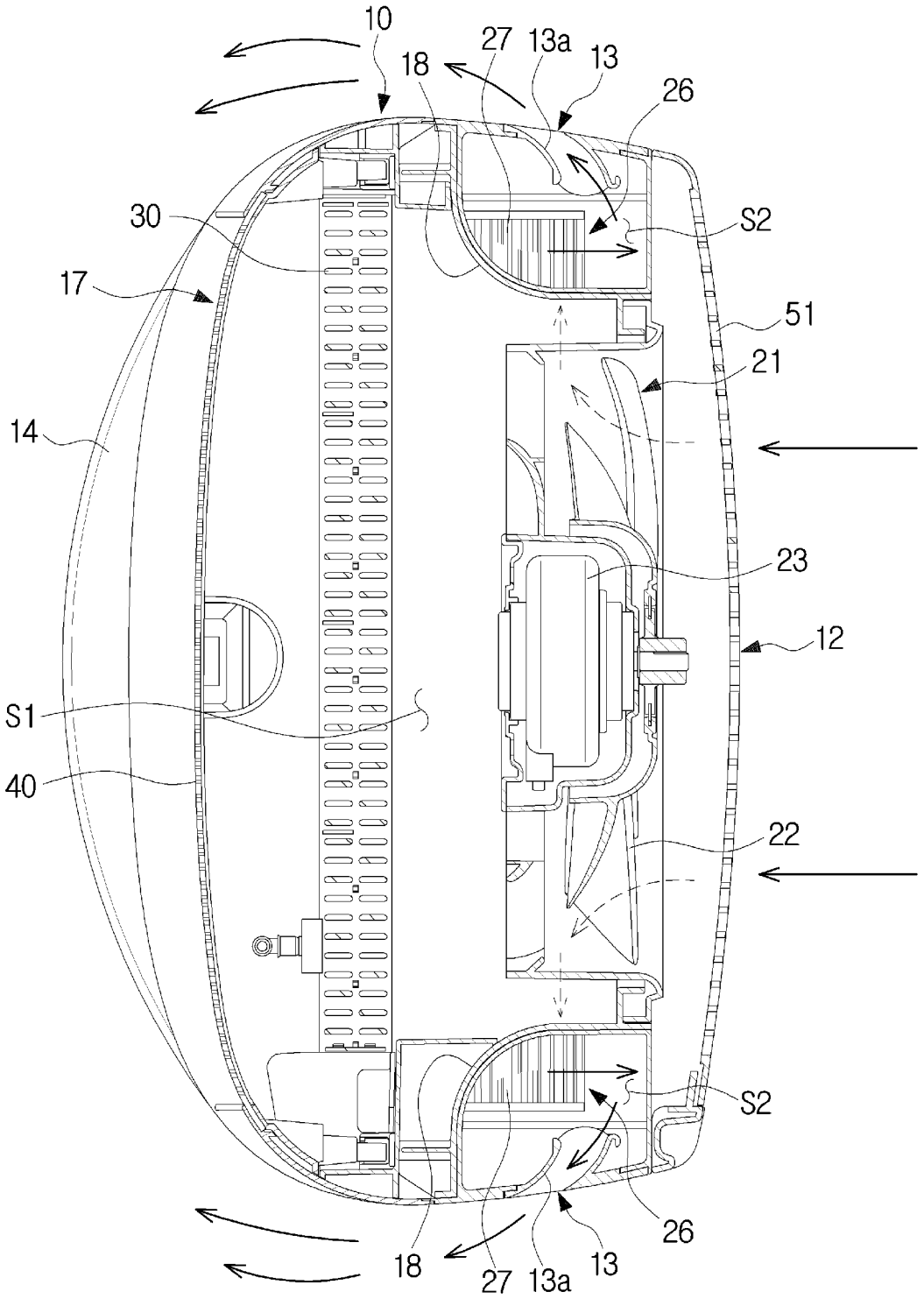
FIG. 5 is a cross-sectional view of the air conditioner shown in FIG. 1, taken along line A-A' of FIG. 1, when the air conditioner operates in a second mode.
Figure 6:
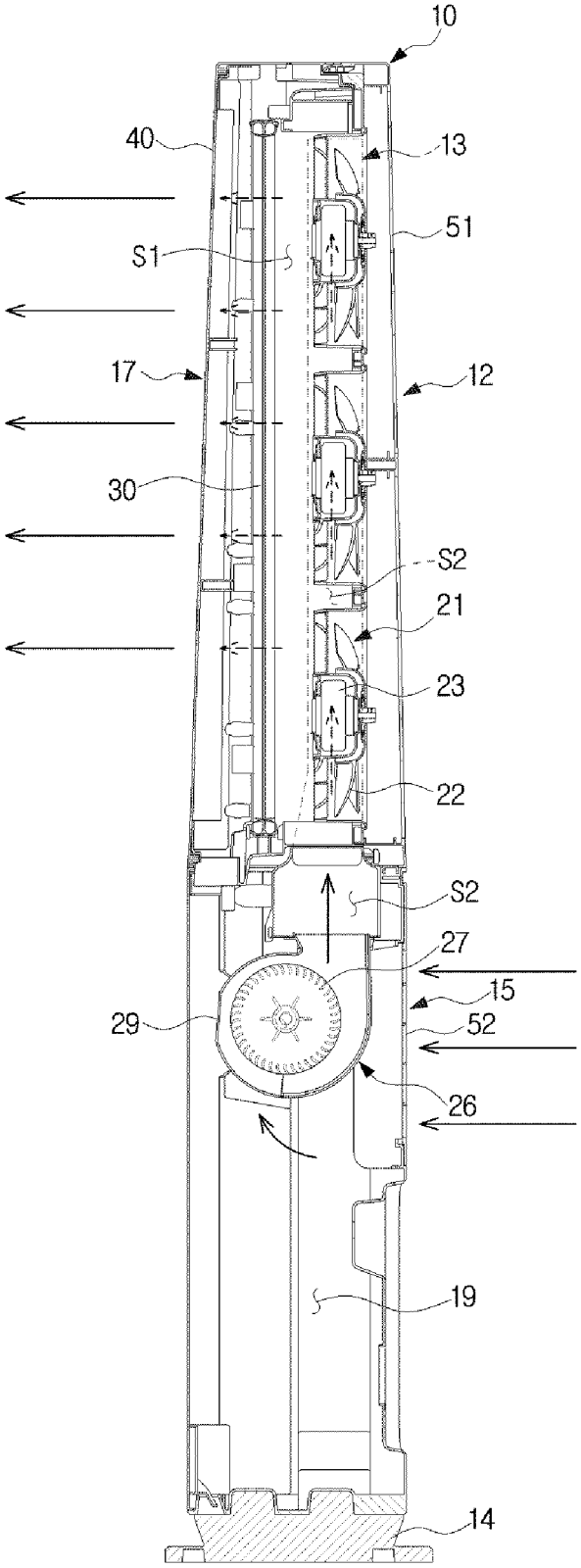
FIG. 6 is a cross-sectional view of the air conditioner shown in FIG. 1, taken along line B-B' of FIG. 1, when the air conditioner operates in the second mode.
Figure 7:
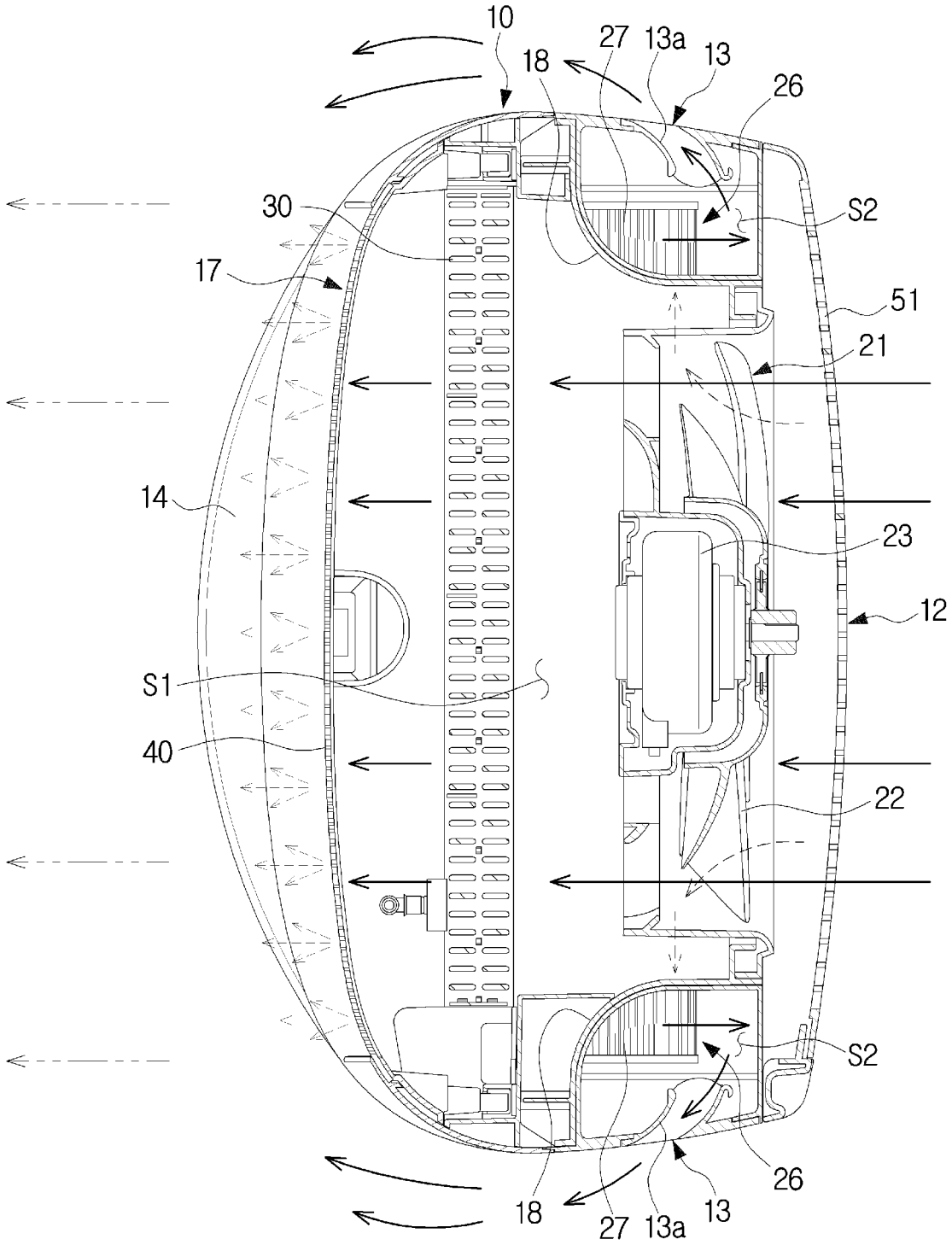
FIG. 7 is a cross-sectional view of the air conditioner shown in FIG. 1, taken along line A-A' of FIG. 1, when the air conditioner operates in a third mode.
Figure 8:
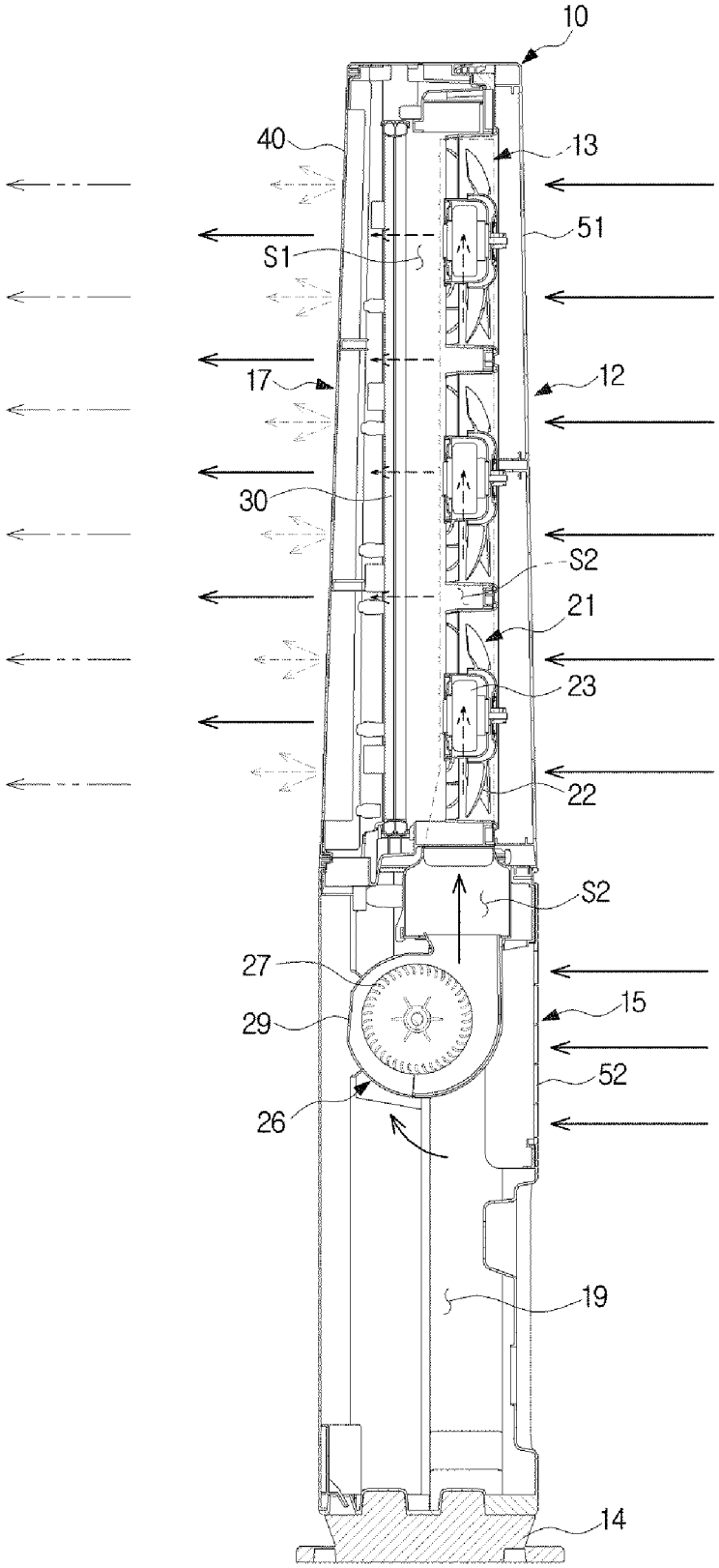
FIG. 8 is a cross-sectional view of the air conditioner shown in FIG. 1, taken along line B-B' of FIG. 1, when the air conditioner operates in the third mode.

FIG. 3 is a cross-sectional view of the air conditioner shown in FIG. 1, taken along line A-A' of FIG. 1, when the air conditioner operates in a first mode. FIG. 4 is a cross-sectional view of the air conditioner shown in FIG. 1, taken along line B-B' of FIG. 1, when the air conditioner operates in the first mode. FIG. 5 is a cross-sectional view of the air conditioner shown in FIG. 1, taken along line A-A' of FIG. 1, when the air conditioner operates in a second mode. FIG. 6 is a cross-sectional view of the air conditioner shown in FIG. 1, taken along line B-B' of FIG. 1, when the air conditioner operates in the second mode. FIG. 7 is a cross-sectional view of the air conditioner shown in FIG. 1, taken along line A-A' of FIG. 1, when the air conditioner operates in a third mode. FIG. 8 is a cross-sectional view of the air conditioner shown in FIG. 1, taken along line B-B' of FIG. 1, when the air conditioner operates in the third mode.

Hereinafter, driving of the air conditioner 1 will be described with reference to FIGS. 3 to 8.

Referring to FIGS. 3 and 4, the air conditioner 1 may be driven in a first mode for discharging heat-exchanged air only through the first discharge port 17. Since the discharge panel 40 is disposed on the first discharge port 17, air-conditioning may be slowly performed in indoor space. That is, when air is discharged to the outside of the housing 10 through the first discharge port 17, wind speed of the air may be reduced when the air passes through the plurality of discharge holes so that the air can be discharged at low speed. According to the configuration, the air conditioner 1 may cool or heat the indoor space at appropriate wind speed at which a user can feel pleasant.

More specifically, when the first blow unit 21 is driven, outside air of the housing 10 may enter the inside of the housing 10 through the first inlet port 12. The air entered the inside of the housing 10 may pass through the heat exchanger 30 via the first blow unit 21 to exchange heat. The heat-exchanged air passed through the heat exchanger 30 may pass through the discharge panel 40, and thereby be discharged at low speed to the outside of the housing 10 through the first discharge port 17. That is, heat-exchanged air discharged through the first flow path 51 may be discharged at wind speed at which a user can feel pleasant.

In the first mode, the second blow unit 26 may be not driven, and accordingly, no air may be discharged through the second discharge port 13.

Referring to FIGS. 5 and 6, the air conditioner 1 may be driven in a second mode for discharging air not heat-exchanged only through the second discharge port 13. Since no heat exchanger is disposed on the second flow path S2, the air conditioner 1 may circulate indoor air.

Since the guide curved portion 13*a* is formed in the second discharge port 13, air discharged through the second discharge port 13 may be discharged toward the front direction of the air conditioner 1. Since the blade 61 is disposed on the second discharge port 13, the air may be blown farther toward the front direction.

More specifically, when the second blow unit 26 is driven, outside air of the housing 10 may enter the inside of the housing 10 through the second inlet port 15. The air entered the inside of the housing 10 may pass through the second blow unit 26, and then move to space of the second flow path S2, formed to both sides of the first flow path S1. Then, the air may move upward on the second flow path S2, and then be discharged to the outside of the housing 10 through the second discharge port 13. At this time, the air may be guided in the front direction of the air conditioner 1 along the guide curved portion 13*a*.

In the second mode, the first blow unit 21 may be not driven, and accordingly, no air may be discharged through the first discharge port 17. That is, in the second mode, the air conditioner 1 may blow air not heat-exchanged so as to perform a function of circulating indoor air or to provide a strong wind to a user.

Referring to FIGS. 7 and 8, the air conditioner 1 may be driven in a third mode for discharging heat-exchanged air through the first discharge port 17 and the second discharge port 13. The air conditioner 1 may discharge cool air farther in the third mode than in the first mode.

More specifically, when the air conditioner 1 is driven in the third mode, cool air discharged through the first discharge port 17 may be mixed with cool air discharged through the second discharge port 13. Also, since air discharged through the second discharge port 13 is discharged at higher speed than air discharged through the first discharge port 17, the air discharged through the second discharge port 13 may move cool air discharged through the first discharge port 17 farther.

According to the configuration, the air conditioner 1 can provide the user with pleasant cool air mixed with indoor air.

In addition, the air conditioner 1 may change a driving force of the first blow unit 21 and/or the second blow unit 26, thereby providing cool air to different distances. That is, the first blow unit 21 may adjust air volume and/or wind speed of air to be discharged through the first discharge port 17, and the second blow unit 26 may adjust air volume and/or wind speed of air to be discharged through the second discharge port 13.

For example, by increasing a driving force of the second blow unit 26 to increase air volume and/or wind speed of air to be discharged through the second discharge port 13, the air conditioner 1 may move cool air farther. Meanwhile, by decreasing a driving force of the second blow unit 26 to decrease air volume and/or wind speed of air to be discharged through the second discharge port 13, the air conditioner 1 may provide cool air to a relatively short distance.

Figure 9:
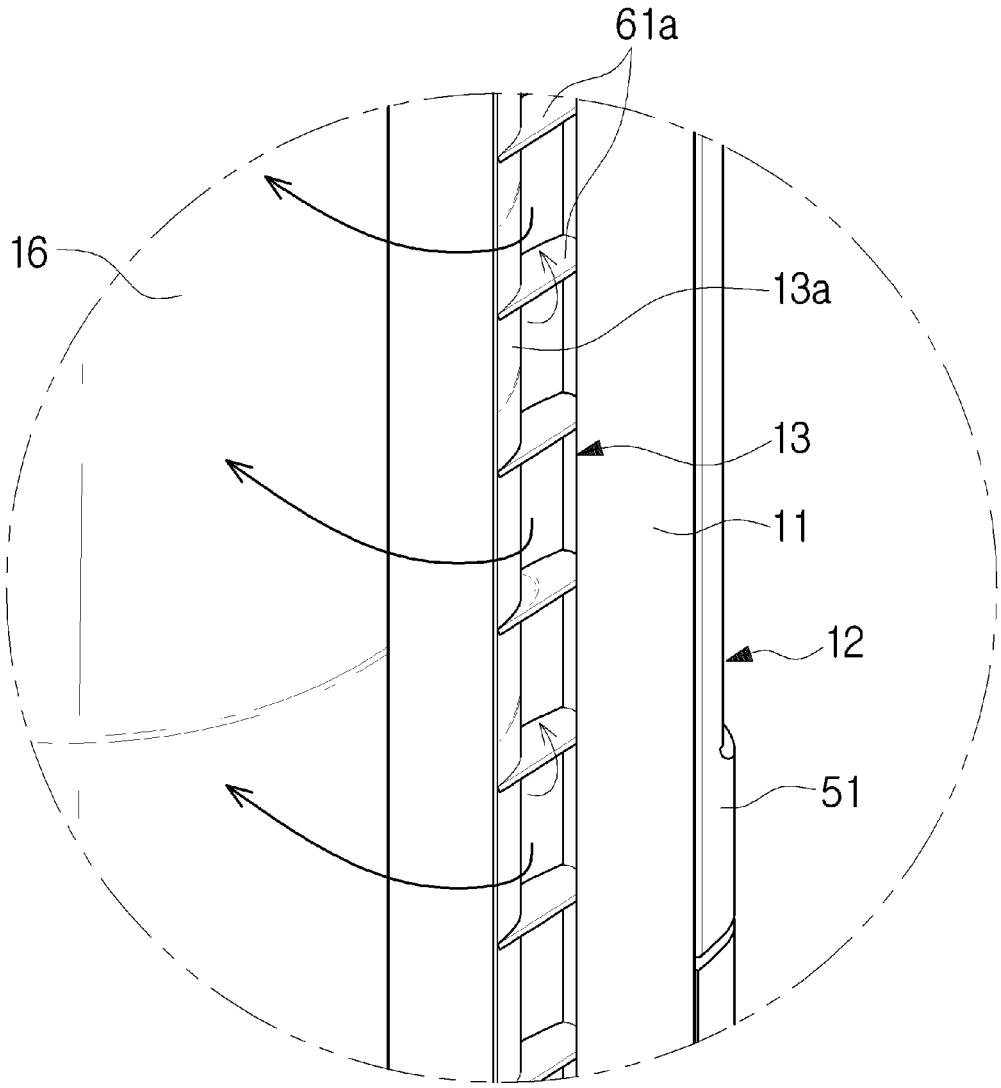
FIGS. 9 and 10 show another embodiment of a blade shown in FIG. 1.
Figure 10:
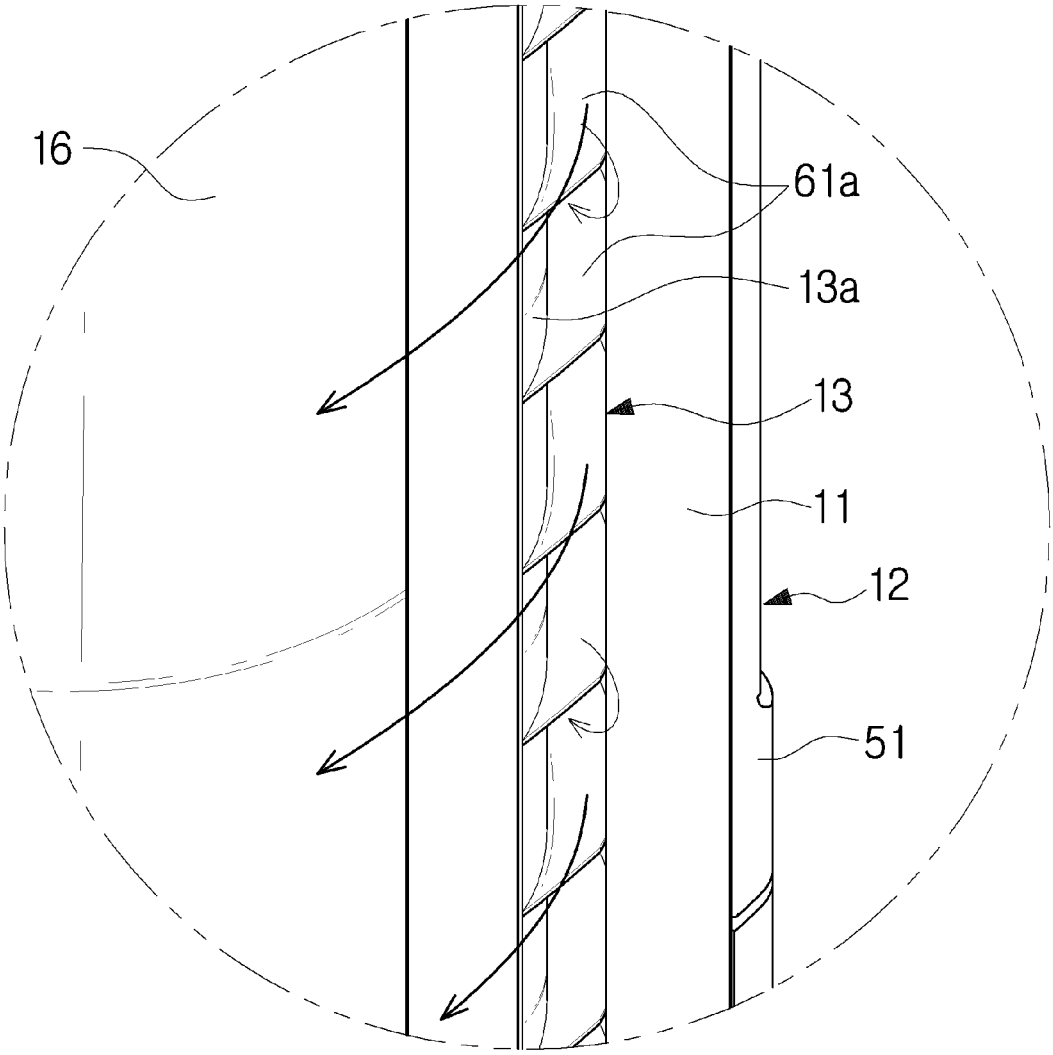

FIGS. 9 and 10 show another embodiment of a blade shown in FIG. 1.

Referring to FIGS. 9 and 10, a blade 61*a* of the air conditioner 1 may be rotatable with respect to the housing 10. The blade 61*a* may be rotatable on a rotation shaft extending in a width direction of the outlet 13. The blade 61*a* may change a wind direction of air discharged through the second discharge port 13 to the up or down direction.

That is, as shown in FIG. 9, the blade 61*a* may rotate with respect to the housing 10 to guide air discharged from the second discharge port 13 upward, and as shown in FIG. 10, the blade 61*a* may rotate with respect to the housing 10 to guide air discharged from the second discharge port 13 downward.

According to the configuration, when the air conditioner 1 is driven in the third mode, the air conditioner 1 may move cool air discharged through the first discharge port 17 upward or downward. Also, the air conditioner 1 may rotate the blade 61*a* continuously to change a wind direction of cool air continuously. In addition, the blade 61*a* may change a wind direction of air discharged through the second discharge port 13 to the left or right direction.

Figure 11:
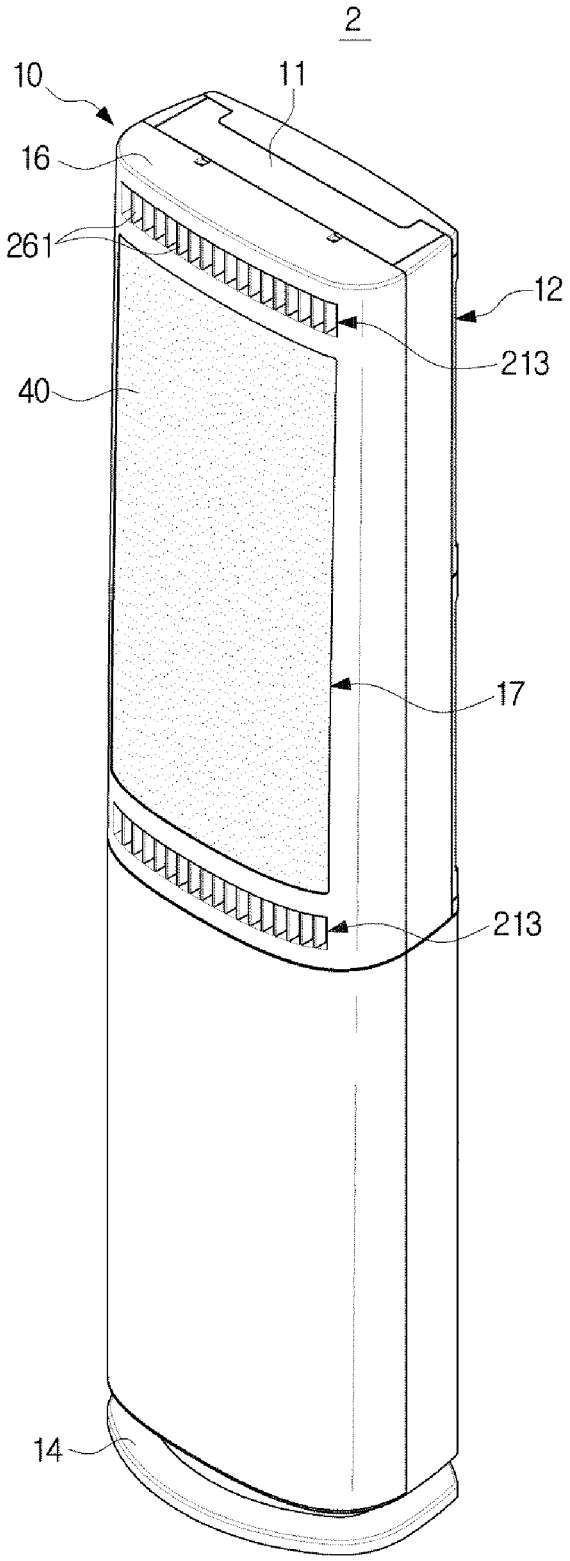
FIGS. 11 and 12 show another embodiment of a second discharge port shown in FIG. 1.
Figure 12:
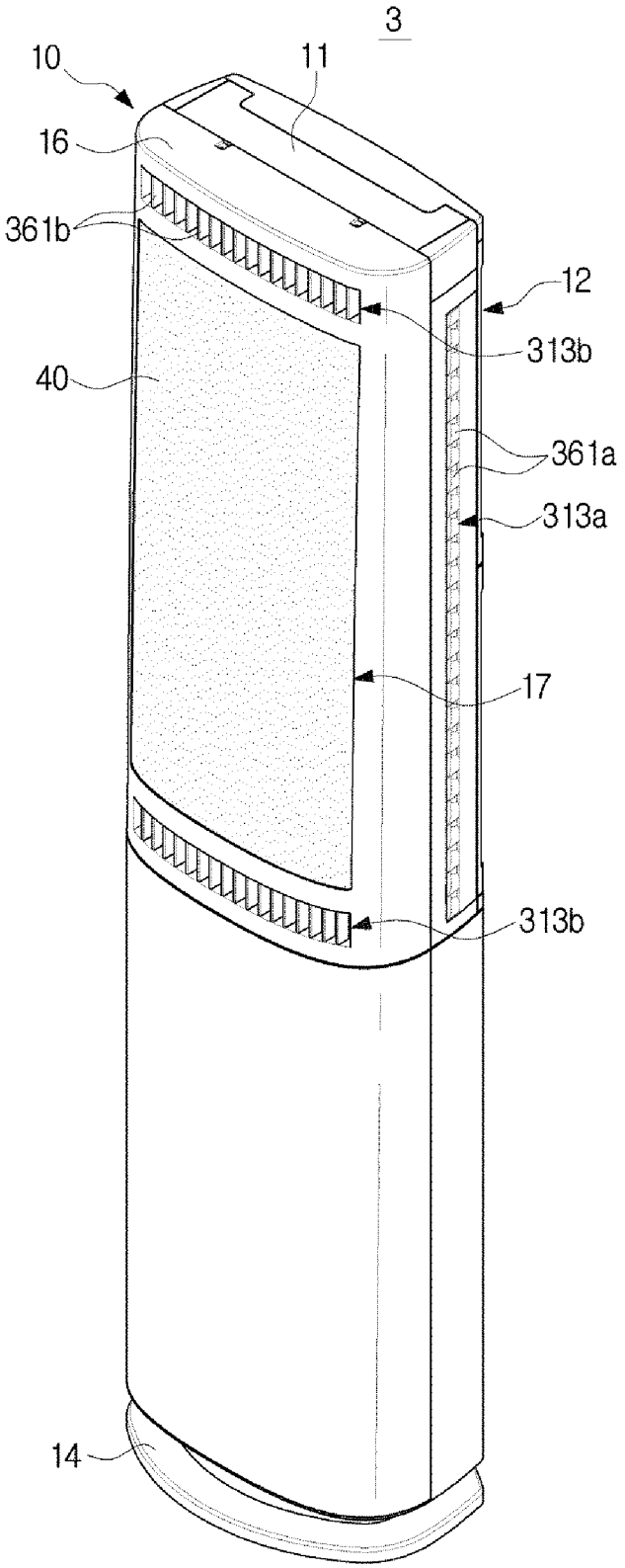

FIGS. 11 and 12 show another embodiment of a second discharge port shown in FIG. 1.

Referring to FIG. 11, a second discharge port 213 may be disposed in the front portion of the housing 10, instead of the sides of the housing 10. The second discharge port 213 may be formed in the front panel 16 of the housing 10. Two second discharge ports 213 may be respectively formed above and below the first discharge port 17. In the second discharge port 213, a blade 261 may be provided to guide air discharged from the second discharge port 213. Unlike this, the second discharge port 213 may be formed above or below the first discharge port 17.

Also, as shown in FIG. 12, second discharge ports 313*a* and 313*b* of an air conditioner 3 may be formed above and below the first discharge port 17 and to the left and right of the first discharge port 17. More specifically, the second discharge ports 313*a* and 313*b* may include second discharge ports 313*a* formed to the left and right of the first discharge port 17, and second discharge ports 313*b* formed above and below the first discharge port 17. On the second discharge ports 313*a* formed above and below the first discharge port 17, blades 361*a* may be formed to guide air discharged from the second discharge ports 313*a*. On the second discharge ports 313*b* formed above and below the first discharge port 17, blades 361*b* may be formed to guide air discharged from the second discharge port 313*b*. The blades 361*a* and 361*b* may be rotatable with respect to the housing 10.

According to the configuration, the air conditioners 2 and 3 can supply pleasant cool air mixed with indoor air in various directions to various distances.

Figure 13:
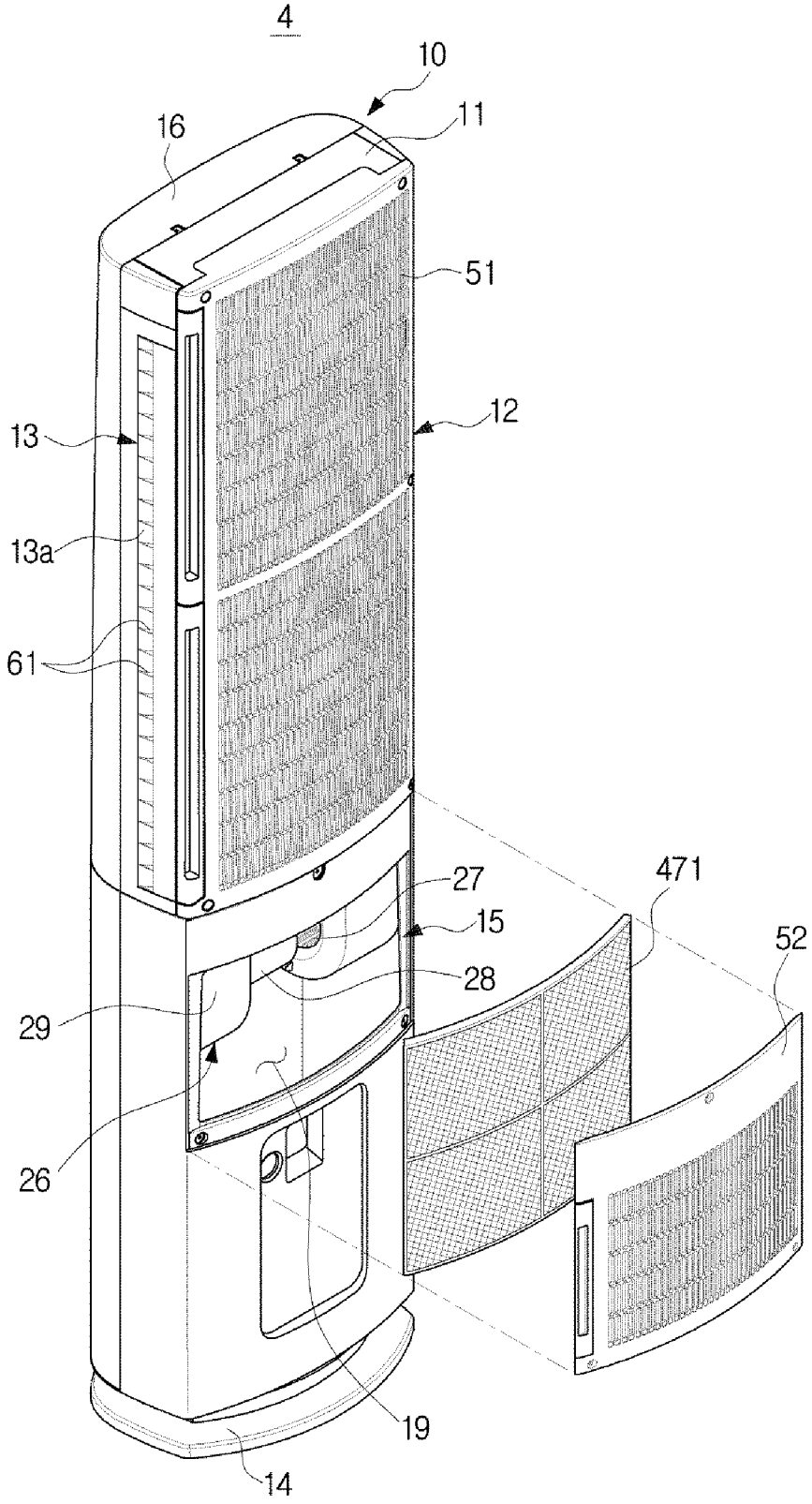
FIG. 13 shows an air conditioner according to another embodiment.

FIG. 13 shows an air conditioner according to another embodiment.

Hereinafter, an air conditioner 4 according to another embodiment of the present disclosure will be described with reference to FIG. 13. In the following description, the same components as those of the above-described embodiment will be assigned the same reference numerals, and descriptions about the components will be omitted.

An air conditioner 4 may include an air cleaning unit 471. The air cleaning unit 471 may be disposed on the second flow path S2. The air cleaning unit 471 may include a filter. The air cleaning unit 471 may be disposed in the accommodating space 19. The air cleaning unit 471 may be replaced with new one by separating the second inlet grill 51 from the housing 10.

The air cleaning unit 471 may be disposed adjacent to the second inlet port 15 to filter air entered through the second inlet port 15. That is, the air conditioner 4 including the air cleaning unit 471 can function as an air cleaner when the second blow unit 26 is driven.

Figure 14:
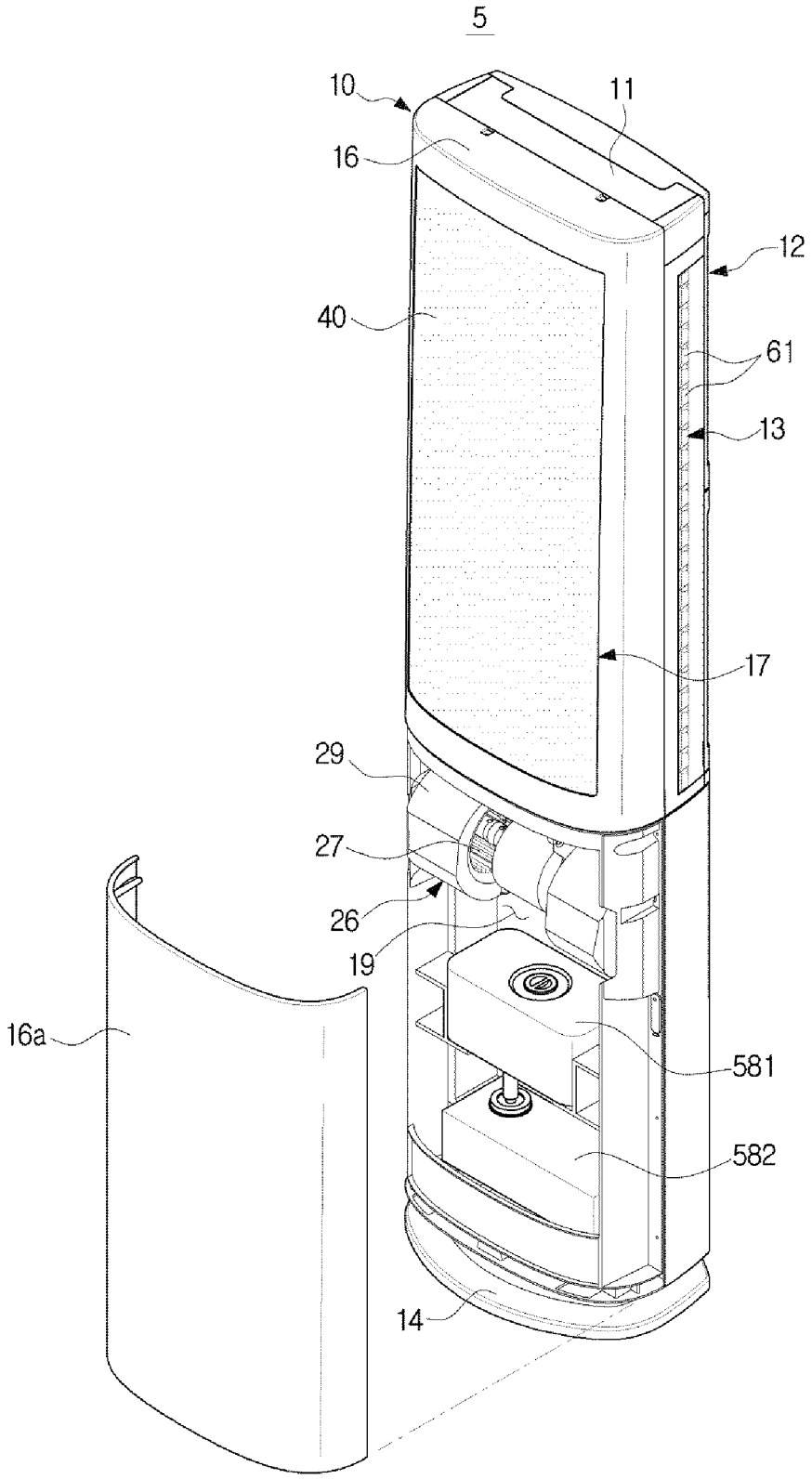
FIG. 14 shows an air conditioner according to still another embodiment.

FIG. 14 shows an air conditioner according to still another embodiment.

Hereinafter, an air conditioner 5 according to still another embodiment of the present disclosure will be described. In the following description, the same components as those of the above-described embodiment will be assigned the same reference numerals, and descriptions about the components will be omitted.

The air conditioner 5 may include a humidification unit 581 and a water trap 582. The humidification unit 581 and the water trap 582 may be disposed on the second flow path S2. Also, the humidification unit 581 and the water trap 582 may be disposed in the accommodating space 19. The humidification unit 581 and the water trap 582 may be replaced with new ones by separating a lower cover 16*a* of the front panel 16 from the housing 10.

The humidification unit 581 may be disposed adjacent to the second inlet port 15 to provide moisture to air entered through the second inlet port 15. The humidified air may be discharged to indoor space through the second discharge port 13. That is, the air conditioner 5 including the humidification unit 581 and the water trap 582 can function as a humidifier when the second blow unit 26 is driven.

FIGS. 15 to 18 show various embodiments of a second blow unit shown in FIG. 2.

Figure 15:
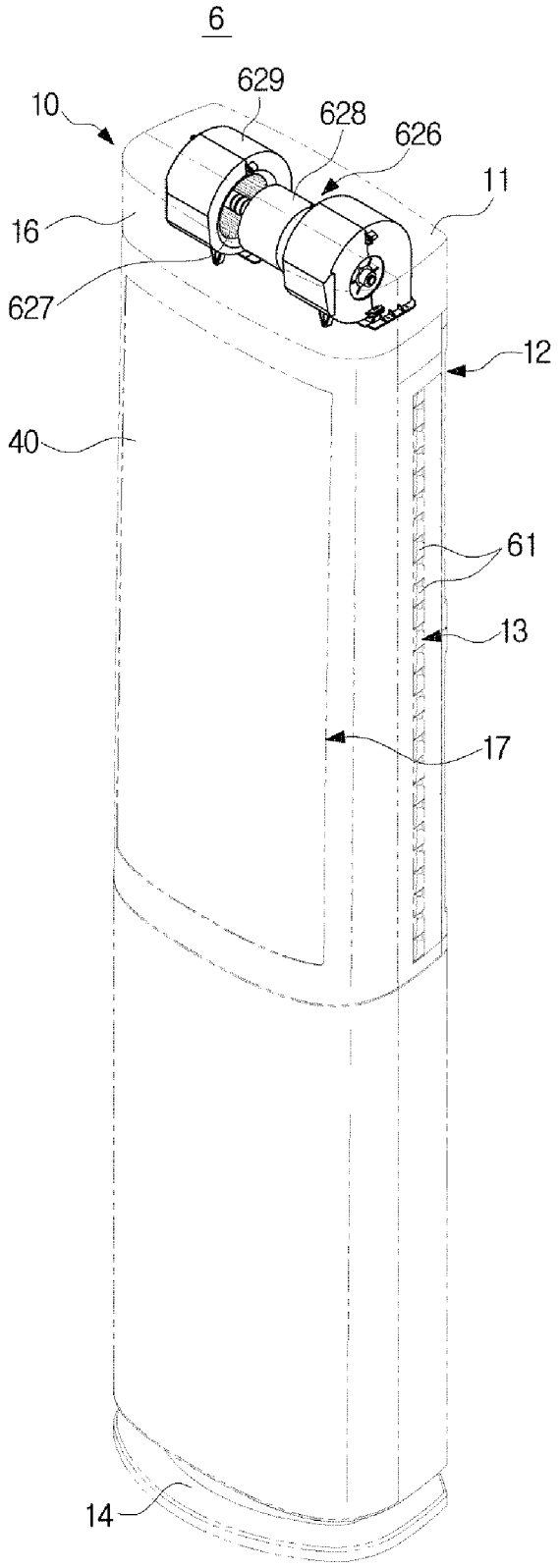
FIGS. 15, 16, 17 and 18 show various embodiments of a second blow unit shown in FIG. 2.

Referring to FIG. 15, a second blow unit 626 of an air conditioner 6 may be disposed at an upper end portion of the housing 10. Accordingly, a second inlet port (not shown) may be formed at a rear upper end of the housing 10. That is, the second inlet port may be disposed above the first inlet port 12.

The second blow unit 626 may include a second fan 627, a second fan driver 628, and a fan case 629. The second blow unit 626 may draw air through the rear portion of the housing 10, and move the drew air to the left and right of the housing 10, in which the second discharge port 13 is formed. That is, the second blow unit 626 may discharge air downward.

Figure 16:
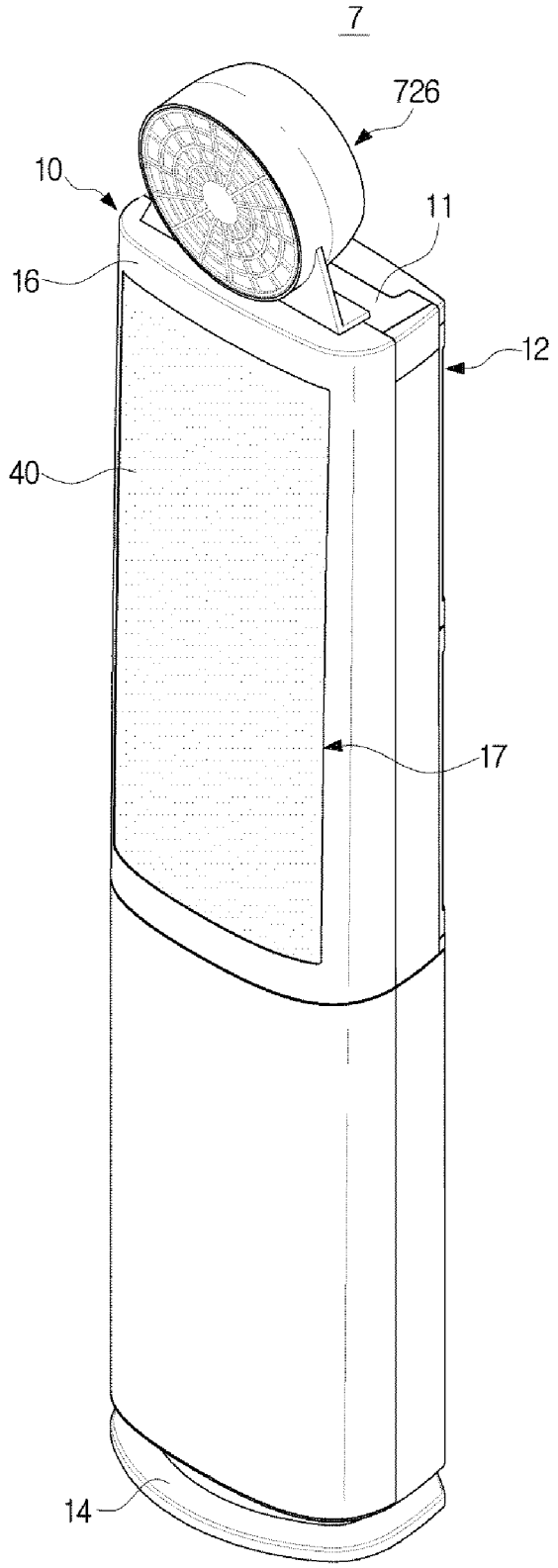

Referring to FIG. 16, an air conditioner 7 may install a second blow unit 726 above the housing 10, instead of forming a second discharge port, to move cool air discharged at low speed from the first discharge port 17 far away. The second blow unit 726 may be a propeller fan.

Figure 17:
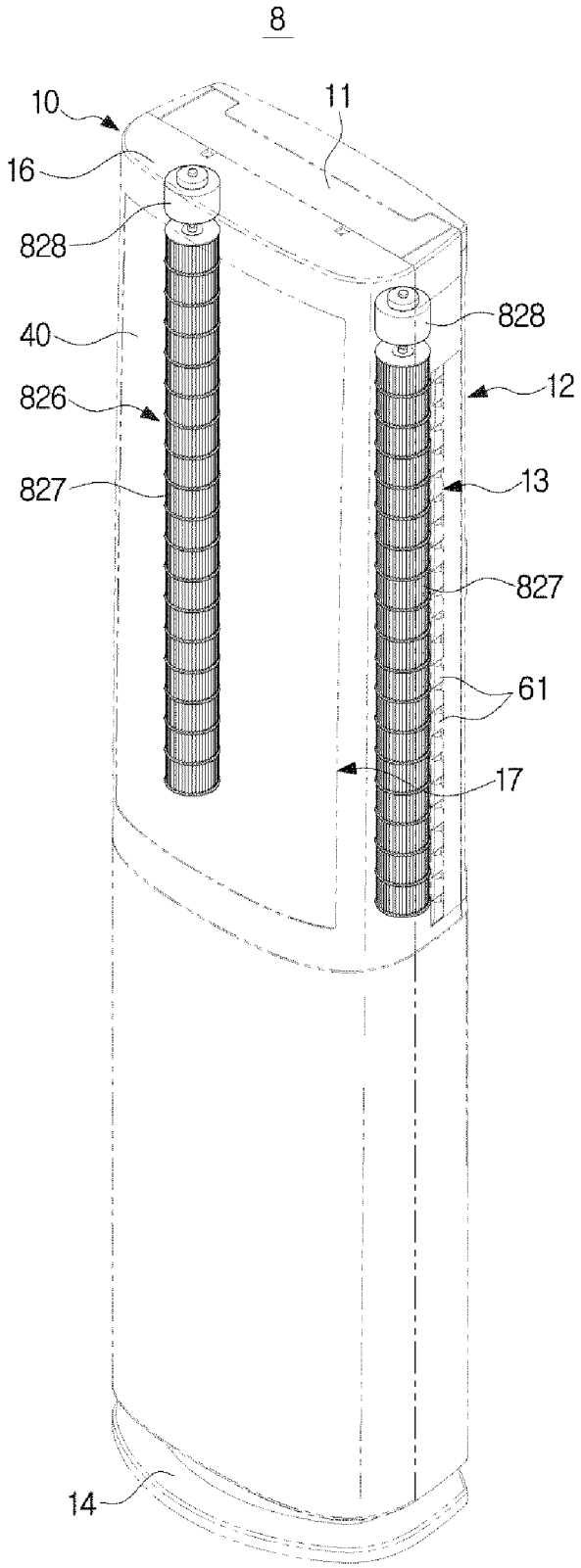

Referring to FIG. 17, a second blow unit 826 may be a crossflow fan. Two second blow units 826 may be respectively disposed at left upper space and right upper space of the inside of the housing 10 in correspondence to the second discharge ports 13. In this case, two second inlet ports (not shown) may be respectively formed to the left and right of the first inlet port 12. The second blow unit 826 may include a second fan 827, and a second fan driver 828 connected to one end of the second fan 827.

Figure 18:
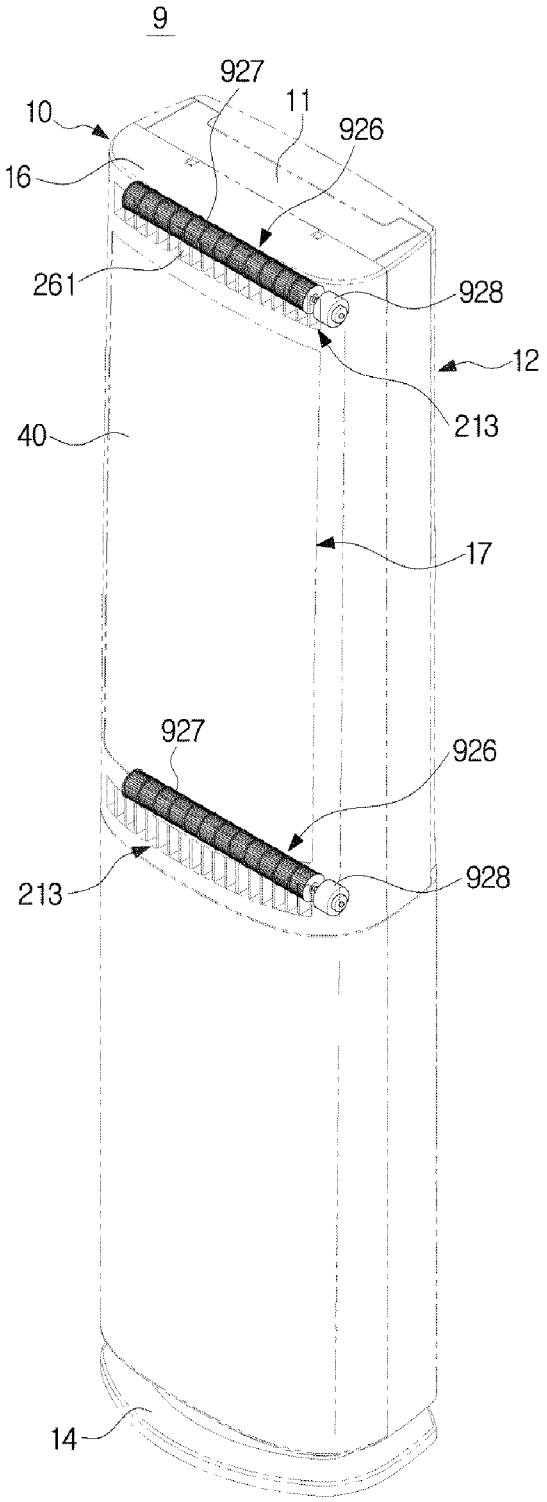

Also, referring to FIG. 18, a second blow unit 926 may be a crossflow fan, like the second blow unit 826 shown in FIG. 17. The second blow unit 926 may be positioned in the inside of the housing 10 to correspond to the second discharge port 213 formed in the front portion of the housing 10. Also, two second inlet ports (not shown) may be respectively formed above and below the first inlet port 12. The second blow unit 926 may include a second fan 927 and a second fan driver 928.

Figure 19:
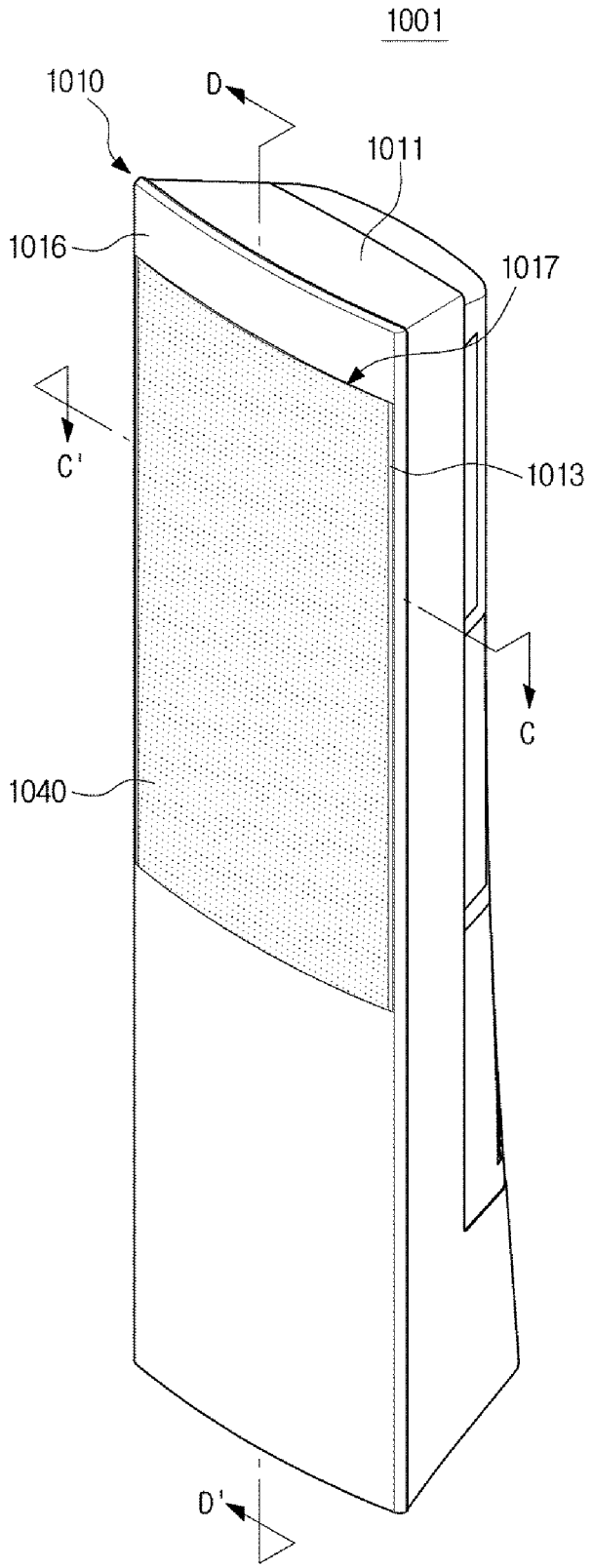
FIG. 19 shows an air conditioner according to still another embodiment.
Figure 20:
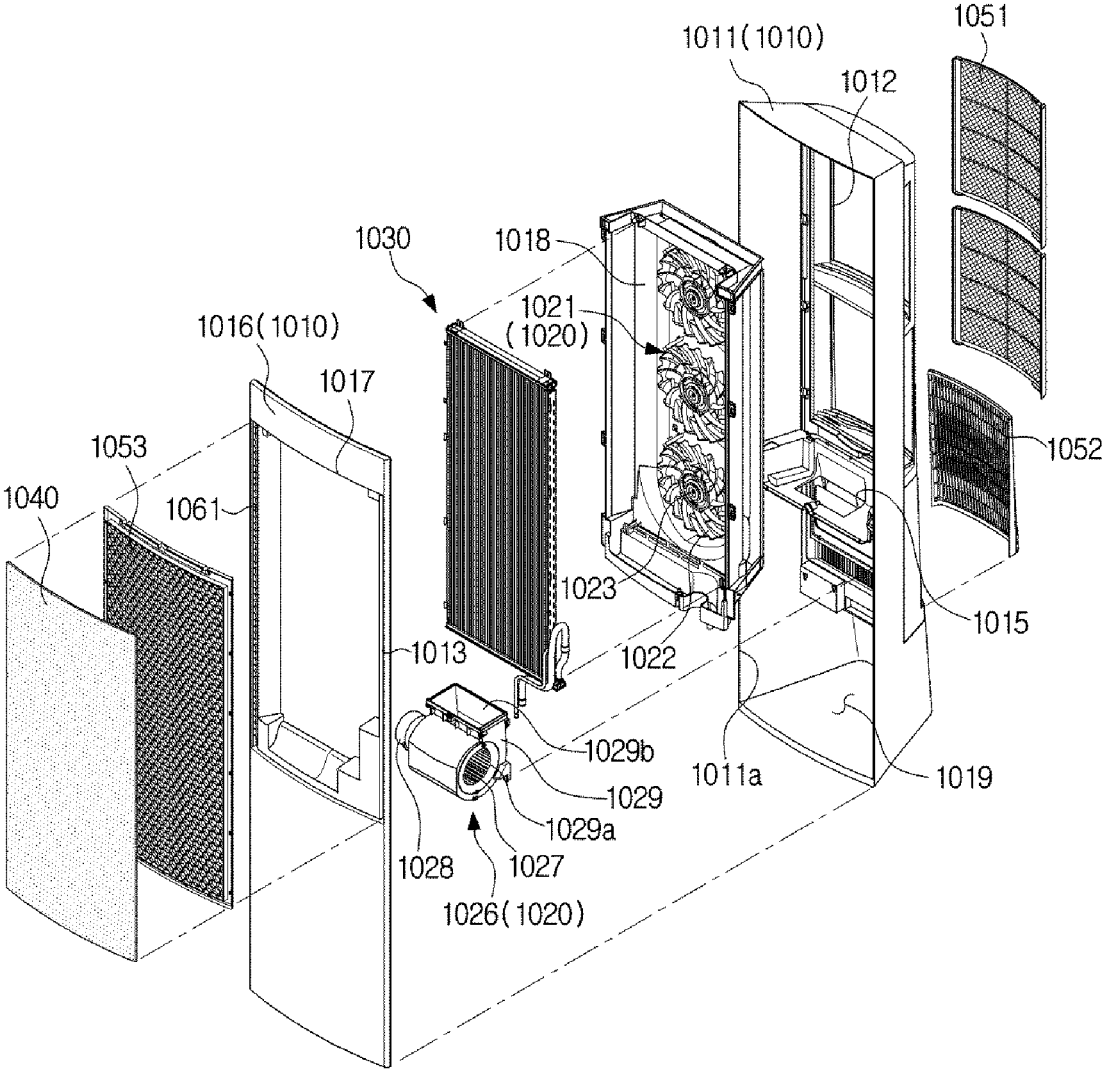
FIG. 20 is an exploded perspective view of the air conditioner shown in FIG. 19.

FIG. 19 shows an air conditioner 1001 according to still another embodiment. FIG. 20 is an exploded perspective view of the air conditioner 1001 shown in FIG. 19.

Referring to FIGS. 19 and 20, an air conditioner 1001 may include a housing 1010 forming an outer appearance of the air conditioner 1001, a blow unit 1020 for circulating air to the inside or outside of the housing 1010, and a heat exchanger 1030 for heat-exchanging air entered the inside of the housing 1010.

The housing 1010 may include a case 1011 in which the blow unit 1020 and the heat exchanger 1030 are installed, and a front panel 1016 for covering a front surface of the case 1011. The housing 1010 may include a first inlet port 1012, a second inlet port 1015, a first discharge port 1017, and a second discharge port 1013.

The case 1011 may form a rear surface of the air conditioner 1001, both side surfaces of the air conditioner 1001, an upper surface of the air conditioner 1001, and a bottom surface of the air conditioner 1001. The case 1011 may open the front surface to form a case opening 1011*a* and the case opening 1011*a* may be covered by the front panel 1016.

The front panel 1016 may be coupled to the case 1011 so as to cover the case opening 1011*a*. the front panel 1016 may be coupled to the case opening 1011*a*. In FIG. 20, the front panel 1016 is shown to be separable from the case 1011, however, the front panel 1016 may be integrated into the case 1011.

In the front panel 1016, the first discharge port 1017 may be formed. The first discharge port 1017 may be formed in the front surface of the housing 1010. The first discharge port 1017 may penetrate the front panel 1016. The first discharge port 1017 may be formed in an upper portion of the front panel 1016. The first discharge port 1017 may face the first inlet port 1012. Air heat-exchanged in the inside of the housing 1010 may be discharged to the outside of the housing 1010 through the first discharge port 1017. The first discharge port 1017 may discharge air entered through the first inlet port 1012.

In the case 1011, the first inlet port 1012 may be formed. The first inlet port 1012 may penetrate a rear portion of the case 1011. The first inlet port 1012 may be formed in a rear upper portion of the case 1011. Outside air may enter the inside of the housing 10 through the first inlet port 1012.

In the embodiment of FIG. 20, two first inlet ports 1012 are formed. However, the number of the first inlet ports 1012 is not limited to two. That is, an arbitrary number of the first inlet ports 1012 may be provided as necessary. In FIG. 20, the first inlet port 1012 is in the shape of a square. However, the shape of the first inlet port 1012 is also not limited to a square, and may have various shapes as necessary.

In the case 1011, the second inlet port 1015 may be formed. The second inlet port 1015 may penetrate the rear portion of the case 1011. The second inlet port 1015 may be formed in a rear lower portion of the case 1011. The second inlet port 1015 may be formed below the first inlet port 1012. Outside air may enter the inside of the housing 1010 through the second inlet port 1015.

Like the first inlet port 1012, the second inlet port 1015 may be formed in various numbers and/or shapes as necessary.

The second discharge port 1013 may be formed in the front panel 1016. The second discharge port 1013 may be formed on the left side and/or right side of the first discharge port 1017. The second discharge port 1013 may be disposed adjacent to the first discharge port 1017. The second discharge port 1013 may be spaced apart from the first discharge port 1017 by a predetermined distance.

The second discharge port 1013 may extend in up and down directions of the case 1011. The second discharge port 1013 may have a length approximately equal to the length of the first discharge port 1017. Air not heat-exchanged in the inside of the housing 1011 may be discharged to the outside of the housing 1010 through the second discharge port 1013. The second discharge port 1013 may discharge air entered through the second inlet port 1015.

The second discharge port 1013 may mix air to be discharged therethrough with air to be discharged through the first discharge port 1017. More specifically, in the portion of the front panel 1016 in which the second discharge port 1013 is formed, a guide curved portion 1013*a* for guiding air to be discharged through the second discharge port 1013 may be formed to mix the air with air to be discharged through the first discharge port 1017.

Air to be discharged through the second discharge port 1013 may flow along the guide curved portion 1013*a* to be mixed with air to be discharged through the first discharge port 1017. The guide curved portion 1013*a* may guide the air discharged through the second discharge port 1013 to be discharged in substantially the same direction as the air discharged through the first discharge port 1017.

On the second discharge port 1013, a plurality of blades 1061 may be provided to guide air to be discharged through the second discharge port 1013. The plurality of blades 1061 may be arranged successively along a longitudinal direction of the second discharge port 1013.

A path of air connecting the first inlet port 1012 to the first discharge port 1017 is referred to as a first flow path S1*a*, and a path of air connecting the second inlet port 1015 to the second discharge port 1013 is referred to as a second flow path S2*a*. Herein, the first flow path S1*a* may be partitioned from the second flow path S2*a*. Accordingly, air flowing along the first flow path S1*a* may be not mixed with air flowing along the second flow path S2*a*.

More specifically, the first flow path S1*a* may be partitioned from the second flow path S2*a* by a partition plate 1018. The partition plate 1018 may extend in the up and down directions in the inside of the housing 1010 where a first blow unit 1021 is installed. The partition plate 1018 may extend in a direction in which the second discharge port 1013 is formed. The partition plate 1018 may protrude convexly from an inner side surface of the housing 1010. The partition plate 1018 may be detachable from the case 1011. The first blow unit 1021 may be installed in the partition plate 1018. The second flow path S2*a* may be formed in the space between the partition plate 1018 and the case 1011.

The air conditioner 1001 may discharge air heat-exchanged with the heat exchanger 1030 through the first discharge port 1017, and discharge air not passed the heat exchanger 1030 through the second discharge port 1013.

That is, the second discharge port 1013 may discharge air not heat-exchanged. Since the heat exchanger 1030 is disposed on the first flow path S1*a*, air discharged through the first discharge port 1017 may be heat-exchanged air. Since no heat exchanger is disposed on the second flow path S2*a*, air discharged through the second discharge port 1013 may be air not heat-exchanged.

However, heat-exchanged air may be discharged through the second discharge port 1013. That is, a heat exchanger may be disposed on the second flow path S2*a*. More specifically, a heat exchanger for heat-exchanging air to be discharged through the second discharge port 1013 may be disposed in accommodating space 1019 of the case 1011. According to the configuration, the air conditioner 1001 may provide heat-exchanged air through both the first discharge port 1017 and the second discharge port 1013.

The case 1011 may have a shape in which the cross section along the horizontal direction becomes wider toward the lower side. According to this shape, the housing 1010 may be stably supported against the floor.

In the inside of the case 1011, the accommodating space 1019 may be formed to accommodate electronic components (not shown). In the accommodating space 1019, electronic components required for driving the air conditioner 1001 may be disposed. A second blow unit 1026 may be disposed in the accommodating space 1019.

The blow unit 1020 may include the first blow unit 1021 and the second blow unit 1026. The second blow unit 1026 may be driven independently from the first blow unit 1021. The second blow unit 1026 may rotate at revolutions per minute (RPM) that is different from that of the first blow unit 1021.

The first blow unit 1021 may be disposed on the first flow path S1*a* formed between the first inlet port 1012 and the first discharge port 1017. Air entered through the first inlet port 1012 may move to the inside of the housing 1010 by the first blow unit 1021. The air entered through the first inlet port 1012 may move along the first flow path S1*a* to be discharged to the outside of the housing 1010 through the first discharge port 1017. The first blow unit 1021 may include a first fan 1022 and a first fan driver 1023.

The first fan 1022 may be an axial-flow fan or a diagonal fan although not limited thereto. However, the first fan 1022 may be any other fan as long as it can make air entered from the outside of the housing 1010 flow to discharge the air to the outside of the housing 1010. For example, the first fan 1022 may be a cross fan, a turbo fan, or a sirocco fan.

In the embodiment of FIG. 20, three first fans 1022 are provided. However, the number of the first fans 1022 is not limited to three. That is, an arbitrary number of the first fans 1022 may be provided as necessary.

The first fan driver 1023 may drive the first fan 1022. The first fan driver 1023 may be disposed at the center of the first fan 1022. The first fan driver 1023 may include a motor.

The second blow unit 1026 may be disposed on the second flow path S2*a* formed between the second inlet port 1015 and the second discharge port 1013. Air entered through the second inlet port 1015 may move to the inside of the housing 1010 by the second blow unit 1026. The air entered through the second inlet port 1015 may move along the second flow path S2*a* to be discharged to the outside of the housing 1010 through the second discharge port 1013.

The second blow unit 1026 may include a second fan 1027, a second fan driver 1028, and a fan case 1029.

The second fan 1027 may be a centrifugal fan although not limited thereto. However, the second fan 1027 may be any other fan as long as it can make air entered from the outside of the housing 1010 flow to discharge the air to the outside of the housing 1010. For example, the second fan 1027 may be a cross fan, a turbo fan, or a sirocco fan.

In the embodiment of FIG. 20, one second fan 1027 is provided. However, the number of the second fans 1027 is not limited to two. That is, an arbitrary number of the second fans 1027 may be provided as necessary.

The second fan driver 1028 may drive the second fan 1027. The second fan driver 1028 may be disposed at one side of the second fan 1027. The second fan driver 1028 may include a motor.

The fan case 1029 may cover the second fan 1027. The fan case 1029 may include a fan inlet 1029*a* through which air enters, and a fan outlet 1029*b* through which air is discharged. The fan inlet 1029*a* and the fan outlet 1029*b* may be disposed at predetermined locations according to the kind of the second fan 1027.

In the second blow unit 1026 shown in FIG. 20, one second fan 1027 is disposed at one end of the second fan driver 1028. However, the configuration of the second blow unit 1026 is not limited to this. For example, the second blow unit 1026 may include a plurality of second fan drivers 1028 and/or a plurality of second fan 1027.

The heat exchanger 1030 may be disposed between the first blow unit 1021 and the first discharge port 1017. The heat exchanger 1030 may be disposed on the first flow path S1*a*. The heat exchanger 1030 may absorb heat from air entered through the first inlet port 1012, or transfer heat to air entered through the first inlet port 1012. The heat exchanger 1030 may include a tube, and a header coupled with the tube. However, the kind of the heat exchanger 1030 is not limited to this.

The air conditioner 1001 may include the discharge panel 1040 disposed in the portion of the front panel 1016 in which the first discharge port 1017 is formed. The discharge panel 1040 may have a plurality of discharge holes to cause air discharged from the first discharge port 1017 to be discharged more slowly than air discharged from the second discharge port 1013. The plurality of discharge holes may penetrate the discharge panel 1040. The plurality of discharge holes may be formed with a fine size. Also, the plurality of discharge holes may be distributed uniformly throughout the entire area of the discharge panel 1040. Heat-exchanged air discharged through the first discharge port 1017 may be discharged at low speed by the plurality of discharge holes.

The air conditioner 1001 may include a first inlet grill 1051 coupled with the portion of the case 1011 in which the first inlet port 1012 is formed. The first inlet grill 1051 may prevent foreign materials from entering through the first inlet port 1012. In order to prevent foreign materials from entering through the first inlet port 1012, the first inlet grill 1051 may include a plurality of slits or holes. The first inlet grill 1051 may cover the first inlet port 1012.

The air conditioner 1001 may include a second inlet grill 1052 coupled with the portion of the case 1011 in which the second inlet port 1015 is formed. The second inlet grill 1052 may prevent foreign materials from entering through the second inlet port 1015. In order to prevent foreign materials from entering through the second inlet port 1015, the second inlet grill 1052 may include a plurality of slits or holes. The second inlet grill 1052 may cover the second inlet port 1015.

The air conditioner 1001 may include a discharge grill 1053 coupled to a portion of the front panel 1016 where the first discharge port 1017 is formed. The discharge grill 1053 may prevent foreign materials from discharging through the first discharge port 1017. In order to prevent foreign materials from discharging through the first discharge port 1017, the discharge grill 1053 may include a plurality of slits or holes. The discharge grill 1053 may cover the first discharge port 1017.

Figure 21:
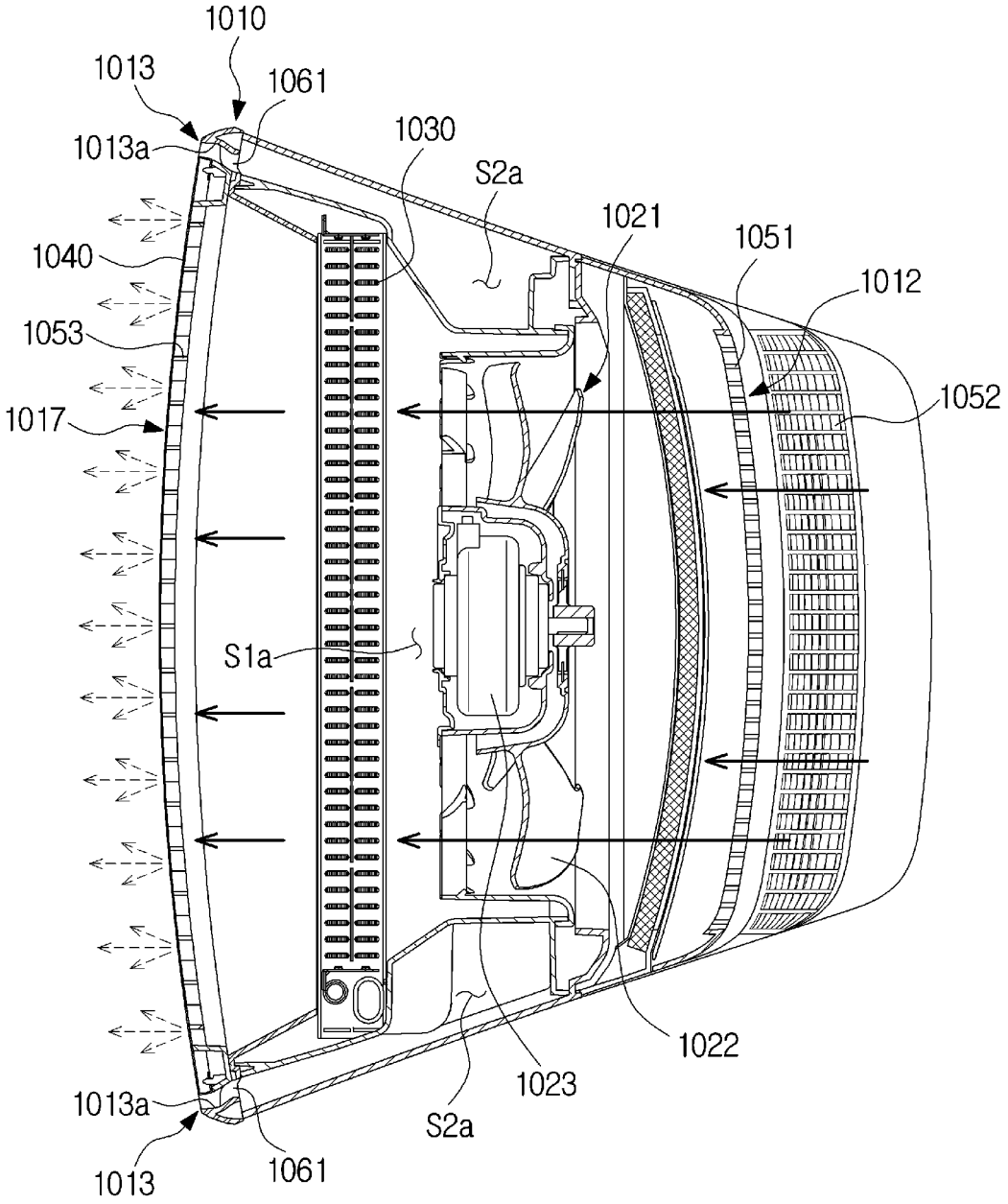
FIG. 21 is a cross-sectional view of the air conditioner shown in FIG. 19, taken along line C-C' of FIG. 19, when the air conditioner operates in a first mode.
Figure 22:
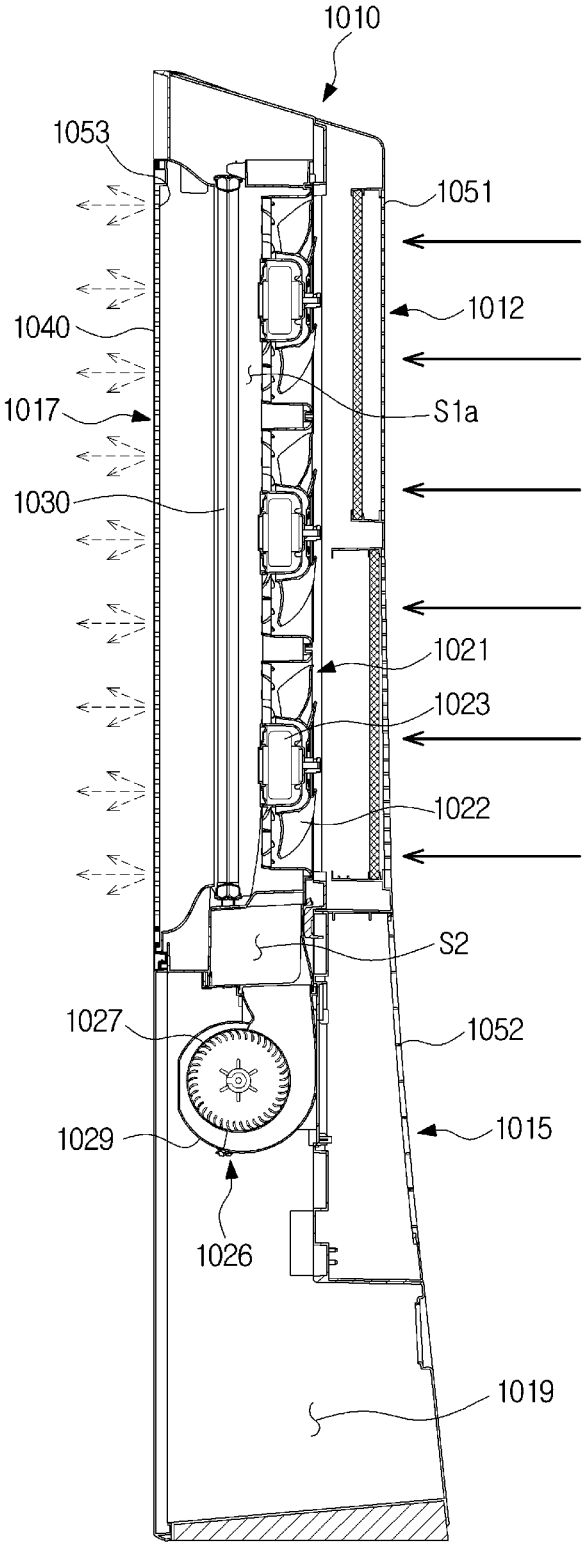
FIG. 22 is a cross-sectional view of the air conditioner shown in FIG. 19, taken along line D-D' of FIG. 19, when the air conditioner operates in the first mode.
Figure 23:
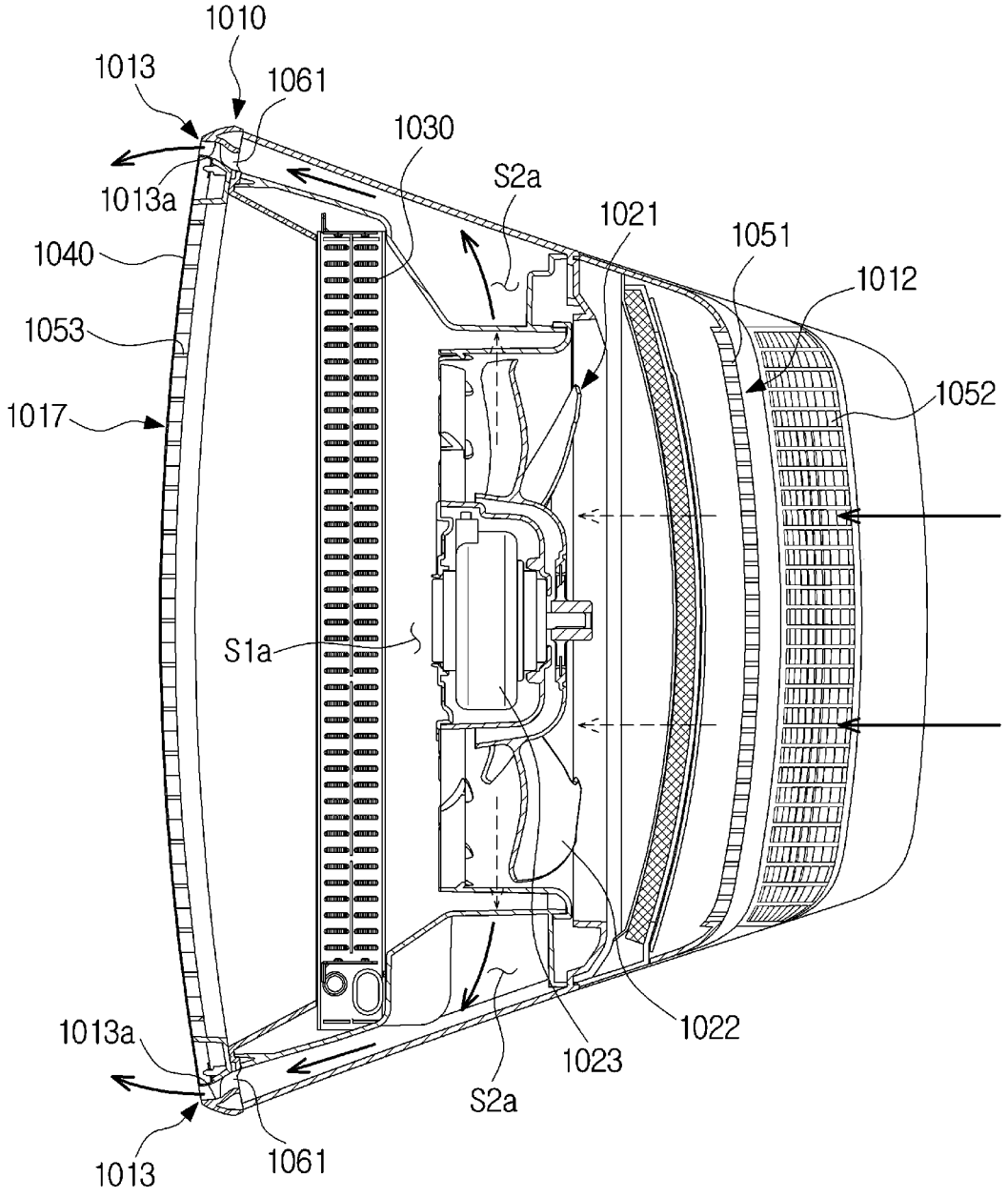
FIG. 23 is a cross-sectional view of the air conditioner shown in FIG. 19, taken along line C-C' of FIG. 19, when the air conditioner operates in a second mode.
Figure 24:
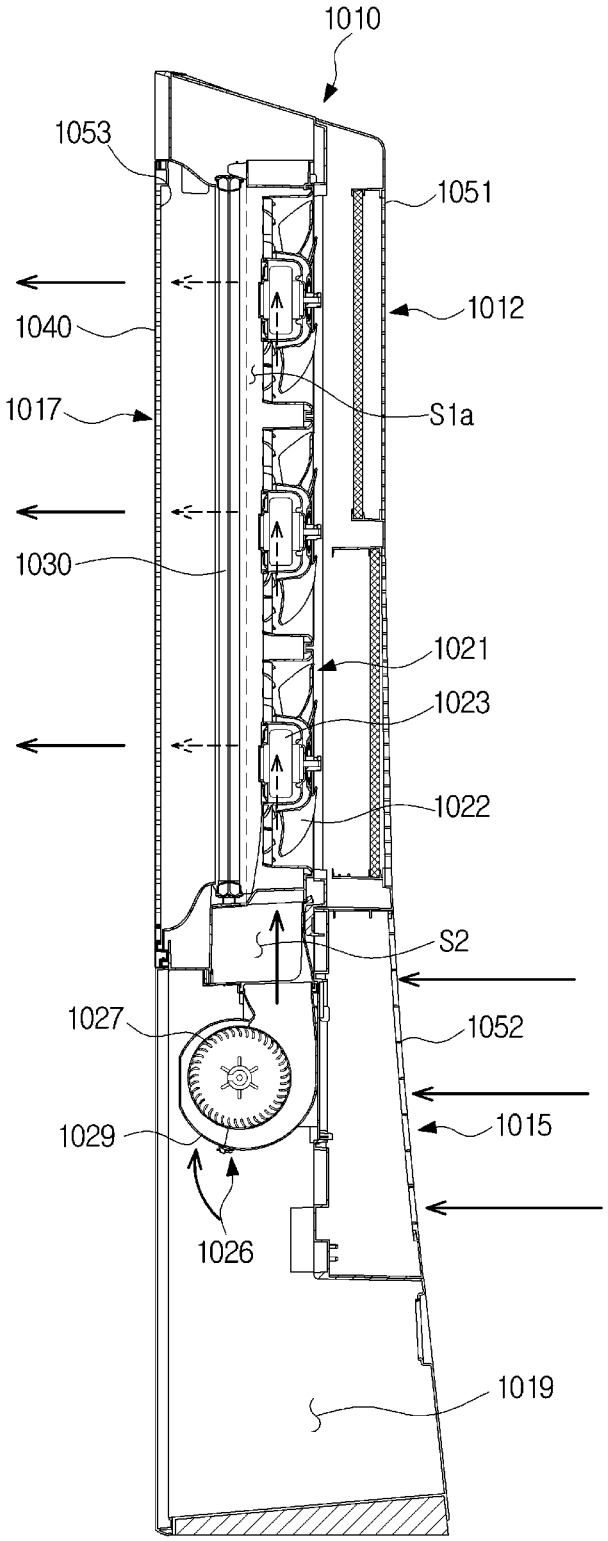
FIG. 24 is a cross-sectional view of the air conditioner shown in FIG. 19, taken along line D-D' of FIG. 19, when the air conditioner operates in the second mode.
Figure 25:
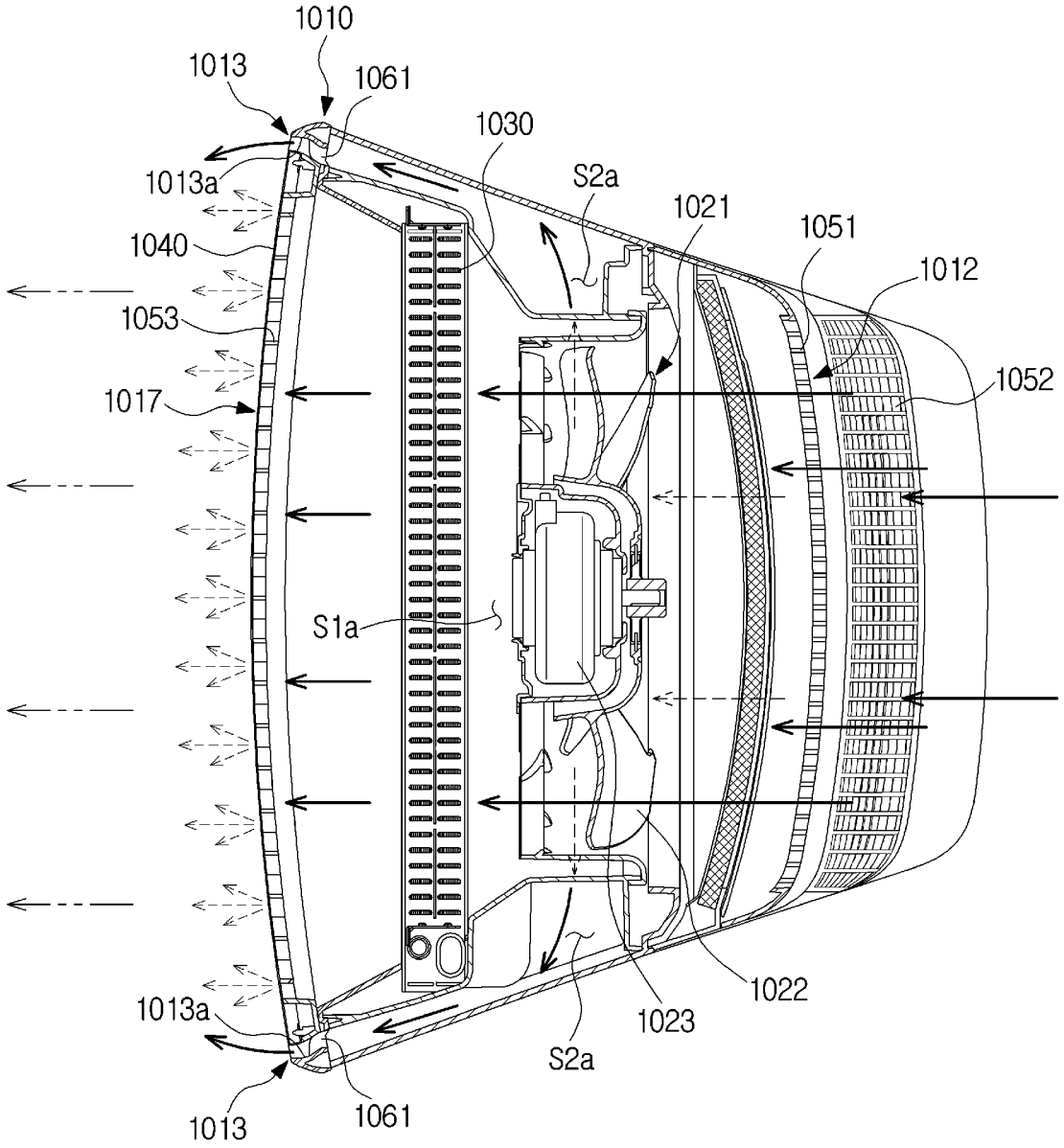
FIG. 25 is a cross-sectional view of the air conditioner shown in FIG. 19, taken along line C-C' of FIG. 19, when the air conditioner operates in a third mode.
Figure 26:
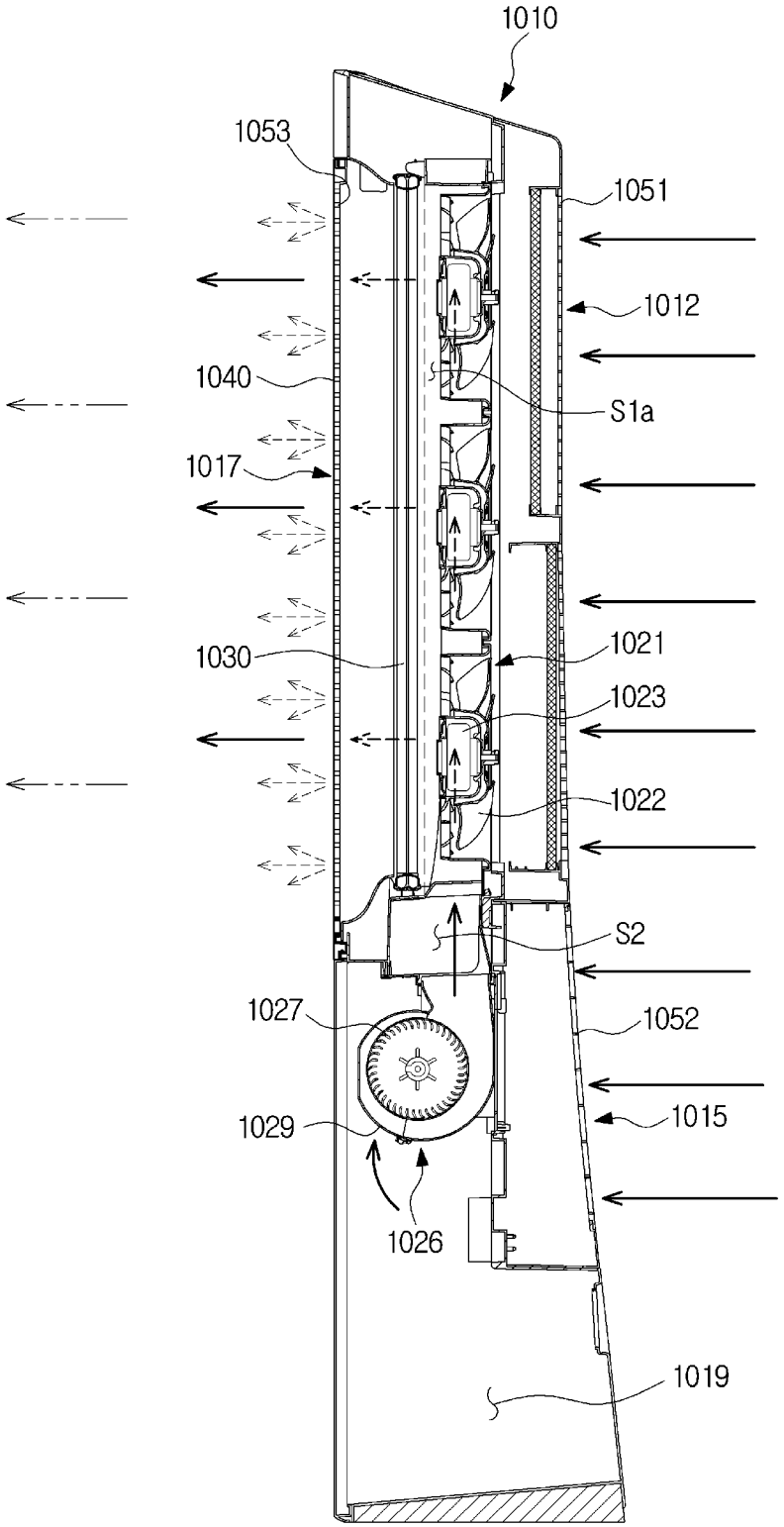
FIG. 26 is a cross-sectional view of the air conditioner shown in FIG. 19, taken along line D-D' of FIG. 19, when the air conditioner operates in the third mode.

FIG. 21 is a cross-sectional view of the air conditioner 1001 shown in FIG. 19, taken along line C-C' of FIG. 19, when the air conditioner 1001 operates in a first mode. FIG. 22 is a cross-sectional view of the air conditioner 1001 shown in FIG. 19, taken along line D-D' of FIG. 19, when the air conditioner 1001 operates in the first mode. FIG. 23 is a cross-sectional view of the air conditioner 1001 shown in FIG. 19, taken along line C-C' of FIG. 19, when the air conditioner 1001 operates in a second mode. FIG. 24 is a cross-sectional view of the air conditioner 1001 shown in FIG. 19, taken along line D-D' of FIG. 19, when the air conditioner 1001 operates in the second mode. FIG. 25 is a cross-sectional view of the air conditioner 1001 shown in FIG. 19, taken along line C-C' of FIG. 19, when the air conditioner 1001 operates in a third mode. FIG. 26 is a cross-sectional view of the air conditioner 1001 shown in FIG. 19, taken along line D-D' of FIG. 19, when the air conditioner 1001 operates in the third mode.

Hereinafter, driving of the air conditioner 1001 will be described with reference to FIGS. 21 to 26.

Referring to FIGS. 21 and 22, the air conditioner 1001 may be driven in a first mode for discharging heat-exchanged air only through the first discharge port 1017. Since the discharge panel 1040 is disposed on the first discharge port 1017, air-conditioning may be slowly performed in indoor space. That is, when air is discharged to the outside of the housing 1010 through the first discharge port 1017, wind speed of the air may be reduced when the air passes through the plurality of discharge holes so that the air can be discharged at low speed. According to the configuration, the air conditioner 1001 may cool or heat the indoor space at appropriate wind speed at which a user can feel pleasant.

More specifically, when the first blow unit 1021 is driven, outside air of the housing 1010 may enter the inside of the housing 1010 through the first inlet port 1012. The air entered the inside of the housing 1010 may pass through the heat exchanger 1030 via the first blow unit 1021 to exchange heat. The heat-exchanged air passed through the heat exchanger 1030 may pass through the discharge panel 1040, and thereby be discharged at low speed to the outside of the housing 1010 through the first discharge port 1017. That is, heat-exchanged air discharged through the first flow path S1*a* may be discharged at wind speed at which a user can feel pleasant.

In the first mode, the second blow unit 1026 may be not driven, and accordingly, no air may be discharged through the second discharge port 1013.

Referring to FIGS. 23 and 24, the air conditioner 1001 may be driven in a second mode for discharging air not heat-exchanged only through the second discharge port 1013. Since no heat exchanger is disposed on the second flow path S2*a*, the air conditioner 1001 may circulate indoor air.

Since the guide curved portion 1013*a* is formed in the second discharge port 1013, air discharged through the second discharge port 1013 may be discharged toward the front direction of the air conditioner 1001. Since the blade 1061 is disposed on the second discharge port 1013, the air may be blown farther toward the front direction.

More specifically, when the second blow unit 1026 is driven, outside air of the housing 1010 may enter the inside of the housing 1010 through the second inlet port 1015. The air entered the inside of the housing 1010 may pass through the second blow unit 1026, and then move to space of the second flow path S2*a*, formed to both sides of the first flow path S1*a*. Then, the air may move upward on the second flow path S2*a*, and then be discharged to the outside of the housing 1010 through the second discharge port 1013.

In the second mode, the first blow unit 1021 may be not driven, and accordingly, no air may be discharged through the first discharge port 1017. That is, in the second mode, the air conditioner 1001 may blow air not heat-exchanged so as to perform a function of circulating indoor air or to provide a strong wind to a user.

Referring to FIGS. 25 and 26, the air conditioner 1001 may be driven in a third mode for discharging heat-exchanged air through the first discharge port 1017 and the second discharge port 1013. The air conditioner 1001 may discharge cool air farther in the third mode than in the first mode.

More specifically, when the air conditioner 1001 is driven in the third mode, cool air discharged through the first discharge port 1017 may be mixed with cool air discharged through the second discharge port 1013. Also, since air discharged through the second discharge port 1013 is discharged at higher speed than air discharged through the first discharge port 1017, the air discharged through the second discharge port 1013 may move cool air discharged through the first discharge port 1017 farther.

According to the configuration, the air conditioner 1001 can provide the user with pleasant cool air mixed with indoor air.

In addition, the air conditioner 1001 may change a driving force of the first blow unit 1021 and/or the second blow unit 1026, thereby providing cool air to different distances. That is, the first blow unit 1021 may adjust air volume and/or wind speed of air to be discharged through the first discharge port 1017, and the second blow unit 1026 may adjust air volume and/or wind speed of air to be discharged through the second discharge port 1013.

For example, by increasing a driving force of the second blow unit 1026 to increase air volume and/or wind speed of air to be discharged through the second discharge port 1013, the air conditioner 1001 may move cool air farther. Meanwhile, by decreasing a driving force of the second blow unit 1026 to decrease air volume and/or wind speed of air to be discharged through the second discharge port 1013, the air conditioner 1001 may provide cool air to a relatively short distance.

According to a technical idea of the present disclosure, since the air conditioner includes the first discharge port on which the discharge panel having the plurality of discharge holes is disposed and the second discharge port for normal blowing, the air conditioner can perform various air discharge methods.

According to another technical idea of the present disclosure, since the air conditioner includes the first discharge port on which the discharge panel having the plurality of discharge holes is disposed, the air conditioner can cool or heat indoor space at minimum wind speed at which a user can feel pleasant.

According to another technical idea of the present disclosure, since the air conditioner can discharge air through the second flow path on which no heat exchanger is disposed, the air conditioner can provide natural wind not heat-exchanged.

According to another technical idea of the present disclosure, since the air conditioner includes the guide curved portion for guiding air to be discharged through the second discharge port to mix the air with air to be discharged through the first discharge port, the air conditioner can provide mixed air of heat-exchanged air and indoor air.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing having a first inlet port and a second inlet port;

a first discharge port formed in the housing, and configured to discharge air entered through the first inlet port;

a second discharge port formed in the housing, and configured to discharge air entered through the second inlet port, the air discharged through the second discharge port is mixed with the air discharged through the first discharge port;

a discharge panel disposed in a portion of the housing in which the first discharge port is formed, and having a plurality of discharge holes to cause the air discharged from the first discharge port to be discharged more slowly than the air discharged from the second discharge port;

a heat exchanger configured to heat-exchange the air entered through the first inlet port;

a first fan arranged to draw the air into the housing through the first inlet port, and to discharge the air from the housing through the first discharge port; and a second fan arranged to draw the air into the housing through the second inlet port, and to discharge the air from the housing through the second discharge port.

2. The air conditioner according to claim 1, wherein the housing comprises a guide curved portion formed on the second discharge port, and configured to guide the air to be discharged through the second discharge port so that the air discharged through the second discharge port is mixed with the air discharged through the first discharge port.

3. The air conditioner according to claim 1, further comprising:

a first flow path to connect the first inlet port to the first discharge port so that the air entered through the first inlet port flows through the first flow path and discharges through the first discharge port; and a second flow path to connect the second inlet port to the second discharge port so that the air entered through the first inlet port flows through the first flow path and discharges through the first discharge port, and partitioned from the first flow path so that the first flow path and the second flow path are independent of each other.

4. The air conditioner according to claim 2, wherein the first discharge port is formed in a front surface of the housing, the second discharge port is formed in at least one side of the housing, and the guide curved portion guides the air to be discharged through the second discharge port, toward a front direction.

5. The air conditioner according to claim 4, wherein the first inlet port and the second inlet port are formed in a rear surface of the housing.

6. The air conditioner according to claim 1, wherein the second discharge port comprises a blade configured to change a direction of the air to be discharged through the second discharge port.

7. The air conditioner according to claim 3, further comprising an air cleaning unit disposed on the second flow path to filter the air flows through the second flow path.

8. The air conditioner according to claim 3, further comprising a humidification unit disposed on the second flow path to provide moisture to the air flows through the second flow path.

9. The air conditioner according to claim 8, wherein the housing comprises a case in which the humidification unit is installed, and a front panel is attachable to or the detachable from the case.

10. The air conditioner according to claim 1, wherein the first fan comprises an axial-flow fan, and the second fan comprises a centrifugal fan.

11. The air conditioner according to claim 1, wherein the second fan is driven independently from the first fan.

12. The air conditioner according to claim 1, wherein the first fan is configured to adjust air volume and a wind speed of the air to be discharged through the first discharge port, and the second fan is configured to adjust air volume and a wind speed of the air to be discharged through the second discharge port.

13. The air conditioner according to claim 1, wherein the second discharge port is disposed above or below the first discharge port.

14. The air conditioner according to claim 3, wherein the heat exchanger is disposed between the first discharge port and the first fan on the first flow path.

15. The air conditioner according to claim 1, wherein the first discharge port discharges the air entered through the first inlet port and heat-exchanged by the heat exchanger, and the second discharge port discharges the air entered through the second inlet port and not heat-exchanged.

16. An air conditioner comprising:

a housing having a first inlet port and a second inlet port;

a first discharge port formed in the housing, and configured to discharge air entered through the first inlet port;

a second discharge port formed in the housing, and configured to discharge air entered through the second inlet port;

a first flow path to connect the first inlet port to the first discharge port so that the air entered through the first inlet port flows through the first flow path and discharges through the first discharge port;

a second flow path connecting the second inlet port to the second discharge port so that the air entered through the first inlet port flows through the first flow path and discharges through the first discharge port, and partitioned from the first flow path so that the first flow path and the second flow path are independent of each other;

a heat exchanger disposed on the first flow path; and a discharge panel disposed in a portion of the housing in which the first discharge port is formed, and having a plurality of discharge holes through which the air flows through the first flow path is to be discharged, wherein the housing comprises a guide curved portion formed on the second discharge port, and configured to guide the air to be discharged through the second discharge port so that the air discharged through the second discharge port is mixed the air discharged through the first discharge port, and wherein the plurality of discharge holes of the discharge panel cause the air discharged from the first discharge port to be discharged more slowly than the air discharged from the second discharge port.

17. The air conditioner according to claim 16, wherein the second discharge port comprises a blade rotatably coupled with the housing, and configured to change a direction of the air to be discharged through the second discharge port.

18. The air conditioner according to claim 16, wherein the second fan comprises a centrifugal fan.

19. An air conditioner comprising:

a housing having a first inlet port and a second inlet port;

a first discharge port formed in a front surface of the housing, and configured to discharge air entered through the first inlet port;

a second discharge port formed in both sides of the housing, and configured to discharge air entered through the second inlet port;

a first flow path to connect the first inlet port to the first discharge port so that the air entered through the first inlet port flows through the first flow path and discharges through the first discharge port;

a second flow path to connect the second inlet port to the second discharge port so that the air entered through the first inlet port flows through the first flow path and discharges through the first discharge port, and partitioned from the first flow path so that the first flow path and the second flow path are independent of each other; and a heat exchanger disposed on the first flow path, wherein the second discharge port is disposed adjacent to the first discharge port such that the air discharged through the second discharge port is mixed with the air discharged through the first discharge port, and wherein a wind speed of air discharged through the second discharge port is higher than a wind speed of air discharged through the first discharge port.

* * * * *